US005901423A

United States Patent [19]

White et al.

[11] Patent Number: 5,901,423

[45] Date of Patent: May 11, 1999

[54] ENDLESS LOOP FINISHING ASSEMBLY

[75] Inventors: James S. White, Shaftsbury, Vt.; Sadao Yagi, Pittsfield, Mass.

[73] Assignee: Morrison Berkshire, Inc., North Adams, Mass.

[21] Appl. No.: 09/138,113

[22] Filed: Aug. 21, 1998

Related U.S. Application Data

[63] Continuation-in-part of application No. 08/924,170, Sep. 5, 1997.

[51] Int. Cl.[6] ..... D06C 3/06

[52] U.S. Cl. ..... 26/71; 26/1; 26/106; 28/142

[58] Field of Search ..... 26/1, 51, 71, 80, 26/81, 83, 99, 106; 28/142; 162/272, 273, 274; 248/646, 324, 327

[56] References Cited

U.S. PATENT DOCUMENTS

| | | | |
|---|---|---|---|
| 2,950,224 | 8/1960 | Balough | 162/199 |
| 3,149,003 | 9/1964 | Christie et al. | 118/34 |
| 3,547,776 | 12/1970 | Curtis | 162/274 |
| 3,596,372 | 8/1971 | Hundseld | 26/106 |
| 3,617,444 | 11/1971 | Hundseld | 162/275 |
| 3,940,833 | 3/1976 | Troope et al. | 26/18.6 |
| 4,232,435 | 11/1980 | Eriksen | 26/106 |
| 4,256,537 | 3/1981 | Stanislaw | 28/142 |
| 4,400,238 | 8/1983 | Stanislaw et al. | 26/106 |
| 4,495,714 | 1/1985 | Eriksen | 28/142 |
| 4,504,359 | 3/1985 | Eriksen | 162/274 |
| 5,005,272 | 4/1991 | Severinsen | 26/106 |
| 5,312,523 | 5/1994 | Eriksen et al. | 162/274 |
| 5,357,661 | 10/1994 | Eriksen et al. | 26/51 |
| 5,427,653 | 6/1995 | Andersson et al. | 162/199 |

*Primary Examiner*—Amy Vanatta

*Attorney, Agent, or Firm*—Lerner, David, Littenberg, Krumholz & Mentlik, LLP

[57] ABSTRACT

A finishing assembly which includes an outside treatment roll for treating both sides of an endless web without having to remove, turn inside out and reload the endless web onto the finishing assembly. The outside treatment roll is movable and adapted to contact the endless web within an opening defined between a pair of cantilever beams such that the "minimum loop length" of the endless web is preserved. The finishing assembly includes a movable non-contacting treatment assembly which is adapted to be arranged between the cantilever beams such that the non-contacting treatment assembly may be used with or without the outside treatment roll to facilitate different finishing processes. In addition, the finishing assembly may include a pivotable cantilever beam in place of one of the cantilever beams. The pivotable cantilever beam may be rotated out of the finishing assembly, further minimizing the "minimum loop length" of the endless web. Finally, one of the cantilever beams may also be movable from a first position to a second position, wherein when in the second position, that beam is not in the way of the endless web and therefore does not interfere with the web. This again provides for a minimizing of the "minimum loop length."

43 Claims, 20 Drawing Sheets

ENDLESS LOOP FINISHING ASSEMBLY

CROSS REFERENCE TO A RELATED APPLICATION

The present application is a continuation-in-part of commonly assigned U.S. patent application Ser. No. 08/924,170, filed Sep. 5, 1997, the disclosure of which is hereby incorporated by reference herein.

FIELD OF THE INVENTION

The present invention relates to a finishing assembly for treating an endless loop or web which may be later used in a paper making assembly and in particular to an endless web finishing assembly that provides for ways of minimizing endless web loop lengths while providing treatment of both surfaces of the endless web while the endless web remains loaded on the finishing assembly.

BACKGROUND OF THE INVENTION

Paper is produced on paper making assemblies consisting of several paper processing machines. Each of these machines utilizes endless loops or webs (e.g., fabric or felt endless webs). Generally, a paper making assembly includes at least a forming stage, a press stage, a dryer stage and a winding and cutting stage. As part of paper making processes, in general, a slurry pulp mixture is disposed onto a first endless web, i.e., the forming stage felt or web. Most of the water contained in the slurry mixture is removed at this stage at which time the paper begins to take form. That is, the surface of the paper mixture itself begins to reflect the web on which it lies during this initial stage of the process.

This paper forming mixture then moves to a second stage, i.e., the press stage, which employs a second endless web. At this stage, as most of the water has been removed, the paper mixture begins to possess characteristics of finished paper. Here, too, the paper surface being formed is reflective of the surface of the web on which it lies.

Thus, it is desirable for webs in at least these initial two stages to be as smooth as possible and devoid of any imperfections or variations so that the paper, which is formed thereupon, likewise will be smooth and uniform. In this regard, the webs should be endless, instead of pieces sewn together, to make a loop. An endless web eliminates any seams either in the machine direction (i.e., the longitudinal direction in which the endless web rotates, or in the cross machine direction, i.e., the direction perpendicular or transverse to the machine direction. Such a seam would create imperfections, or at least variations in the paper, both of which are unacceptable for paper making assemblies.

Typically, the endless webs also are treated with non-contacting methods such as chemicals, mechanical and radiant energy, or by stretching or other similar methods to achieve a smooth set surface. This setting of the endless webs also must be performed in a consistent manner so as to avoid certain imperfections.

Since the webs are endless, the length of the finishing assemblies used to treat them will usually govern their overall loop length or circumferential length. This is commonly referred to as the "minimum loop length." Certain types of endless web finishing assemblies may include at least one inside treatment roll, which heats the endless web on contact, at least one inside treatment roll, which stretches the endless web, and possibly a non-contacting treatment device such as an air box (or oven), which treats the endless web without contacting it. Also, since the webs or loops are endless, the rolls and/or ovens have to be manipulated and moved out of the way so that the endless web can be loaded onto the finishing assembly and off-loaded from the finishing assembly without interference with the rolls and/or ovens and without damaging the endless web.

These endless webs are fairly large and cumbersome and it is uneconomical in terms of production time and labor costs to remove the endless webs during a treatment session. There also is always the risk of potentially damaging the web when it is being removed and turned. These webs are extremely expensive and may have to be scrapped if enough damage is incurred when unloading and turning them. Thus, it is desirable in the felt making industry to treat both the outside and inside surfaces of the endless web without having to remove or unload them, flip them inside out and reload them onto the finishing assembly again. Collectively, the manipulation of a web is commonly called "felt turning." One way to avoid this felt turning step is to employ an outside treatment device. There is a competing need to keep certain webs as small as possible, i.e., the smallest possible "minimum loop length." This is further discussed below.

Certain of these finishing assemblies include cantilevered supports for supporting one or both of the inside treatment rolls while the endless web is being loaded and unloaded. In these assemblies, the outside treatment device is usually positioned between the outside of a cantilevered support and one of the inside treatment rolls. This is so because an air box or oven set will typically be attached to the inside of the cantilevered support.

In the paper making process discussed above, it is desirable to have at least one relatively short endless web having the shortest "minimum loop length" possible. This web is usually utilized in the first stage, i.e., the forming stage. It also is desirable to treat other endless webs at varying sizes to accommodate various other stages of the paper making processes as mentioned above. Thus, it is desirable to have an endless web finishing assembly which is capable of accommodating the smallest "minimum loop length" as well as at the same time being versatile to accommodate a variety of endless web lengths and treatment processes.

However, with the introduction of an outside treatment device, as discussed above and as generally found in the prior art, the "minimum loop length" would be increased by at least the diameter or linear width of the outside treatment roll since this device is usually placed between one of the inside rolls and adjacent or outside of the cantilevered support to allow room for the air boxes or ovens. Hence, the overall "minimum loop length" is dictated by the total diameters of the inside treatment rolls, the diameter or linear width of the outside treatment device and the width of the air box set, in addition to the amount of wrap (or that portion of the endless web which contacts the rolls).

Assemblies for treating both the outside and inside of an endless web without felt turning are known. But in most of these attempts, the "minimum loop length" is necessarily increased as a result of the added equipment needed to treat the outside of the web. In certain cases, in order to maintain the "minimum loop length," oven sets or other non-contacting treatment assemblies are permanently attached to a cantilevered support or at least a bottom oven is attached and a top oven is movable. However, by keeping these ovens (or at least the bottom oven) permanently attached to a cantilevered support, it considerably reduces the amount of surface area or dwell time an outside contact treatment device can contact the endless web. This is so because to preserve the "minimum loop length," the outside contact treatment device is brought into the same area as the ovens. As such, the outside treatment device cannot be brought up high enough to increase the treatment area (i.e., wrap or dwell time).

U.S. Pat. No. 5,312,523 issued to Erickson et al., discloses a glide surface positioned between a rotatable heatable roller 2 and a rotatable roller 3. Roller 3 is movably mounted for movement toward and away from roller 2, so that it functions as a tension roller. The glide surface 4 is shown between the roller 2 and roller 3. In addition, FIG. 4 of this reference discloses a glide surface 4 and a heater box 15 where the glide surface provides only a small contact surface area. The glide surface is stationary with relation to the movement of the endless web. Thus, there is a resulting relative motion between the glide and the endless web. This relative motion may cause a less than smooth resulting web for several reasons. For instance, since the glide is stationary with respect to the moving endless web, a substantial amount of friction is created. This results in a greater potential for the endless web to bow or skew. This leads to undesirable surface, draining or other mechanical imperfections in the endless web. In addition, since there is a limited contact surface area with the glide, there is less tension control overall and less treatment area per linear foot.

Another example of an endless loop finishing assembly that provides for reducing the "minimum loop length" can be found in the aforementioned, commonly assigned U.S. patent application Ser. No. 08/924,170, the disclosure of which is hereby incorporated by reference herein. In the '170 application, there is provided a finishing assembly for treating an endless web which extends in a machine direction when loaded onto the finishing assembly. The assembly includes a cantilevered support having a generally horizontal free end including at least two cantilever beams extending in a direction generally transverse to the machine direction of the finishing assembly. The two cantilever beams define a transversely-extending open space therebetween. The finishing assembly further includes first and second inside treatment rolls for contacting the inside surface of the endless web to treat the endless web. Each inside treatment roll is arranged to be supported on the cantilevered support when in an endless web loading position. At least one of the inside treatment rolls is movable between the loading position and an endless web treatment position wherein the at least one inside treatment roll is spaced apart from the cantilevered support in a direction generally parallel to the machine direction. Also included in that aspect is a movable roll carriage device for moving the at least one inside treatment roll between the loading position and the treatment position, and an outside treatment roll for contacting the outside surface of the endless web to treat the endless web. The outside treatment roll is movable between a first position and a second position. When in the first position, the outside treatment roll is positioned in the transversely-extending open space and operative to contact the outside surface of the endless web over a predetermined contact surface area, and when in the second position, it is positioned outside of the transversely-extending open space to allow for the endless web to be loaded onto the finishing assembly.

Despite all of the effort which has been devoted to the development of a versatile endless loop finishing assembly capable of being used in various types of universal treatment applications and processes that require "minimal loop lengths," (including the positive results of the aforementioned commonly-owned and assigned invention as disclosed in the '170 application), there are unmet needs for further improvements.

SUMMARY OF THE INVENTION

In accordance with one aspect of the present invention, there is provided a finishing assembly for treating an endless web, the finishing assembly having a machine direction along which the endless web extends when loaded onto the finishing assembly. The finishing assembly includes a cantilevered support which includes a fixed cantilever beam and a pivotable cantilever beam. The fixed cantilever beam extends in a generally horizontal direction transverse to the machine direction of the finishing assembly and has a supported end and a free end. The pivotable cantilever beam extends in a generally horizontal direction and is pivotably mounted so as to be rotatable between a first position extending in a direction generally transverse to the machine direction of the finishing assembly and a second position extending in a direction generally parallel to the machine direction of the finishing assembly. The fixed cantilever beam and the pivotable cantilever beam in the first position define a transversely-extending open space therebetween. The first and second inside treatment rolls contact the inside surface of the endless web to treat the endless web. At least one of the inside treatment rolls is movable between an endless web loading position and an endless web treatment position. The inside treatment rolls are arranged to be supported on at least one of the cantilevered beams when at least one of the inside treatment rolls is in the endless web loading position. At least one of the inside treatment rolls is spaced from the fixed cantilevered beam in a direction generally parallel to the machine direction when at least one of inside treatment rolls is in the endless web treatment position. A movable roll carriage device moves at least one of the inside treatment rolls between the loading position and said treatment position.

In accordance with another aspect of the present invention, there is provided a finishing assembly for treating an endless web, the finishing assembly having a machine direction along which the endless web extends when loaded onto the finishing assembly. The finishing assembly includes a cantilevered support which includes a fixed cantilever beam and a movable cantilever beam. The fixed cantilever beam extends in a generally horizontal direction transverse to the machine direction of the finishing assembly and has a supported end and a free end. The movable cantilever beam extends in a generally horizontal direction and is movable from a first position extending in a direction generally transverse to the machine direction of the finishing assembly and a second position which does not interfere with the endless web or the finishing assembly. The first and second inside treatment rolls contact the inside surface of the endless web to treat the endless web. At least one of the inside treatment rolls is movable between an endless web loading position and an endless web treatment position. The inside treatment rolls are arranged to be supported on at least one of the cantilevered beams when at least one of the inside treatment rolls is in the endless web loading position. At least one of the inside treatment rolls is spaced from the fixed cantilevered beam in a direction generally parallel to the machine direction when at least one of inside treatment rolls is in the endless web treatment position. A movable roll carriage device moves at least one of the inside treatment rolls between the loading position and said treatment position.

BRIEF DESCRIPTION OF THE DRAWINGS

The above and other features, aspects and advantages of the present invention will become apparent, as will a better understanding of the concepts underlying the present invention, by reference to the description which follows and refers to the accompanying drawings in which.

DETAILED DESCRIPTION OF THE PREFERRED EMBODIMENT

The present invention is directed to a finishing assembly for treating an endless web made of, for example, fabric or felt, where the endless web is typically intended for use in paper making assemblies. Of course, however, the endless web may be used in other types of applications such as conveyors, textile making machines or assemblies and/or conveying systems.

Figure 1:
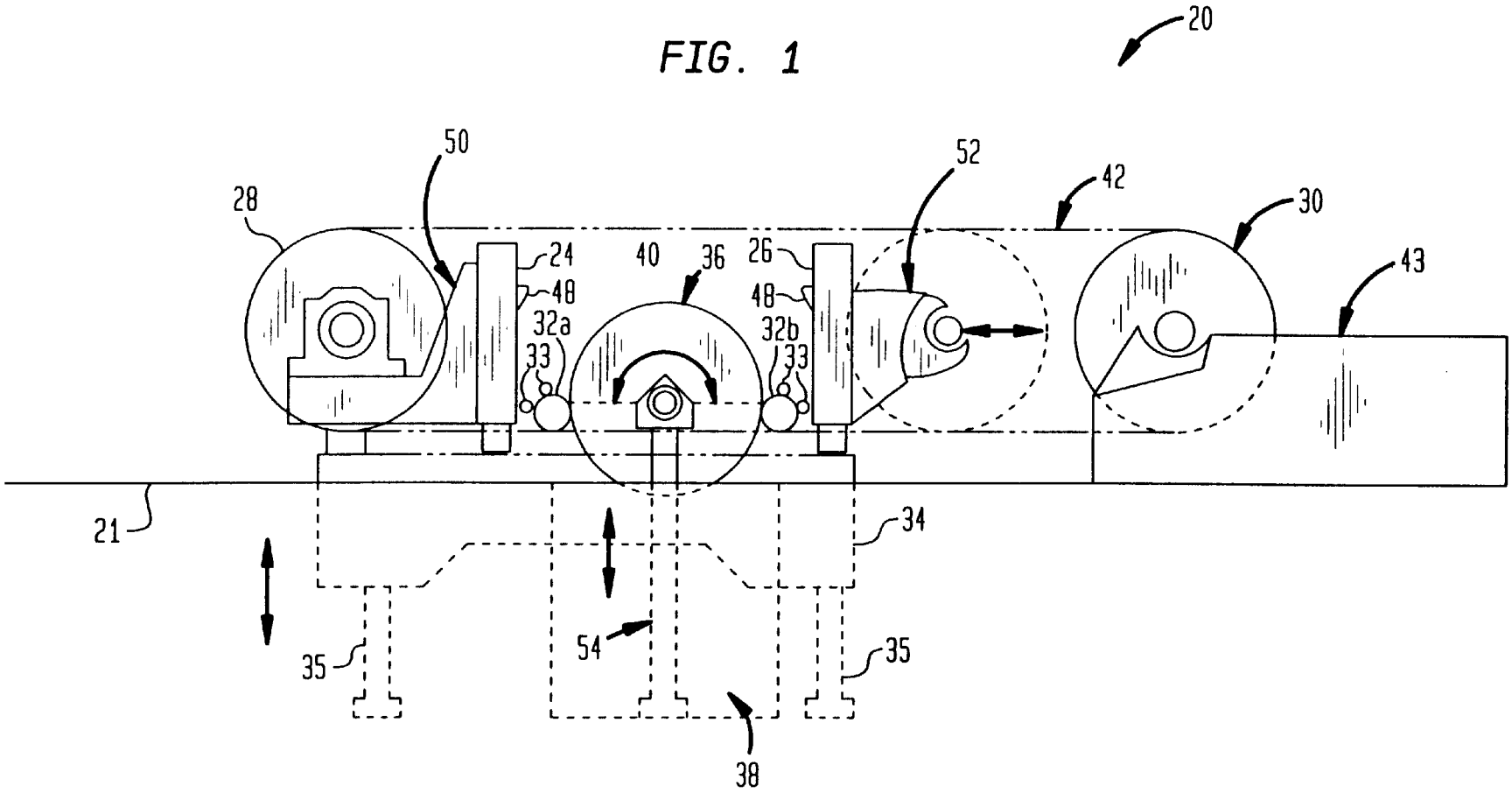
FIG. 1 is a schematic side elevation view of a finishing assembly in accordance with one embodiment of the present invention, illustrating the outside treatment roll in an operational position.

In accordance with one aspect of the present invention, as shown in FIG. 1, there is provided a finishing assembly generally designated 20. The finishing assembly 20 comprises a cantilevered support 22 (not shown in FIG. 1) (see FIGS. 2A to 5 for other variations of the cantilevered support; namely, cantilevered supports 122, 222 and 322), comprised of a pair of cantilever beams 24 and 26, for supporting a first inside treatment roll 28, a second inside treatment roll 30 and a pair of felt guide or felt follower rolls 32*a* and 32*b*. Also shown in the finishing assembly 20 is a drop frame 34, an outside treatment roll 36 and a recessed open space 38. In addition, the finishing assembly 20 discloses an endless loop or web 42. The endless web 42 is shown loaded onto the finishing assembly 20 and in position for treatment. Finally, the finishing assembly 20 includes a movable roll carriage device 43 for moving the inside treatment roll 30 toward and away from the cantilevered support 22.

Figure 2A:
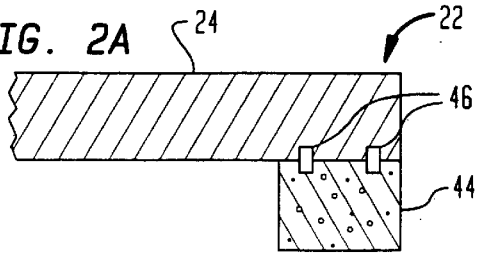
FIG. 2A is a schematic side elevation view of one embodiment of a cantilever beam for use in the cantilevered support of the finishing assembly of FIG. 1.
Figure 2B:
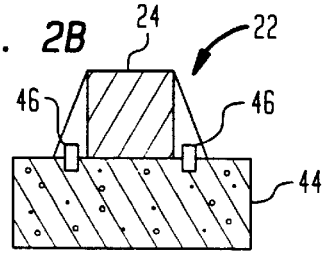
FIG. 2B is a schematic rear elevation view of the cantilever beam of FIG. 2A.
Figure 3A:
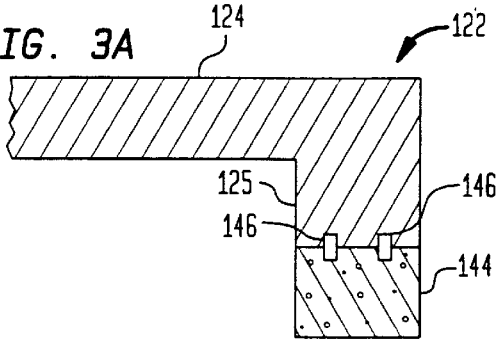
FIG. 3A is a schematic side elevation view of another embodiment of a cantilever beam for use in the cantilevered support of the finishing assembly of FIG. 1.
Figure 3B:
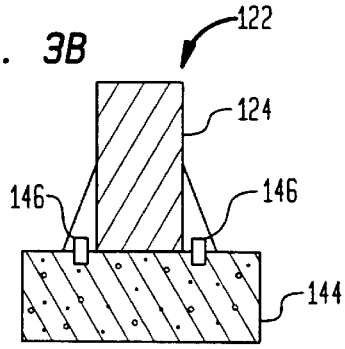
FIG. 3B is a schematic rear view of the cantilever beam of FIG. 3A.

The cantilever beams 24 and 26 define a transversely-extending open space 40 for partially receiving the outside treatment roll 36 and/or a non-contacting treatment assembly (as described below). Several different types of cantilever beams may be used which are within the scope of the present invention. For example, as shown in FIGS. 2A and 2B, there is a cantilevered support 22 including cantilever beam 24. Cantilever beam 24 is attached to a cantilever foundation 44 by fasteners such as bolts 46 or alternatively by other types of fasteners such as concrete anchors or screws and the like. In this particular cantilevered support 22, the cantilever beam 24 may be constructed of any suitable material which is capable of withstanding the loads typically placed upon these beams in machine assemblies such as the ones described herein. Preferably such cantilever beam material may consist of, by way of example, metal such as steel or any other type of suitable material such as composite material and the like. The cantilever foundation 44 may be made of a concrete or concrete-like material, and preferably reinforced concrete. FIGS. 3A and 3B show a variation of the cantilevered support 22 as shown in FIGS. 2A and 2B. In this version, the cantilever beam 124 includes a vertical portion 125. Otherwise, the mechanics of, and materials used to manufacture, these two versions are similar. For instance, in these two versions of a cantilevered support, the cantilever foundations 44 and 144 take a substantial portion of the load carried by the beams instead of the beams themselves.

Figure 4A:
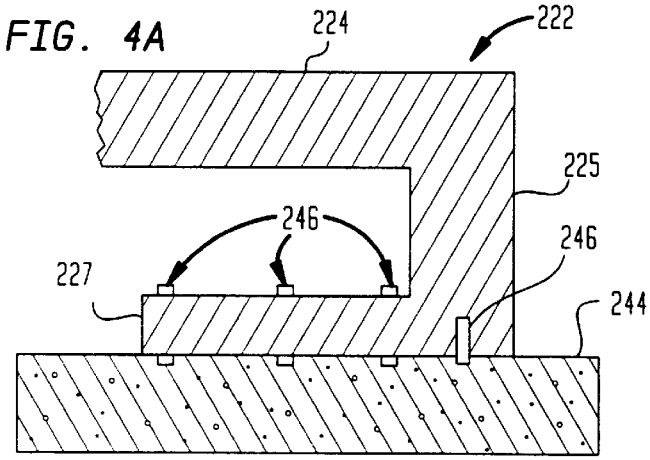
FIG. 4A is a schematic side elevation view of yet another embodiment of a cantilever beam for use in the cantilevered support of the finishing assembly of FIG. 1.
Figure 4B:
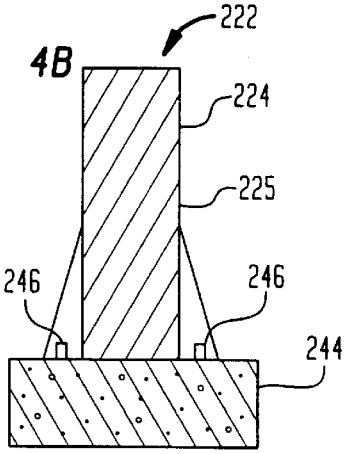
FIG. 4B is a schematic rear view of the cantilever beam of FIG. 4A.

FIGS. 4A and 4B show a typical C-frame cantilevered support 222. This type includes cantilever beam 224, vertical portion 225 and a horizontal portion 227. This cantilevered support 222 is attached to the cantilever foundation 244 in a similar manner as described above, for example, by way of concrete anchors, screws or bolts 246. In contrast to the above two types, in this cantilevered support 222, the frame portion takes the load while the cantilever foundation 244 holds the finishing assembly 20 in place.

Figure 5:
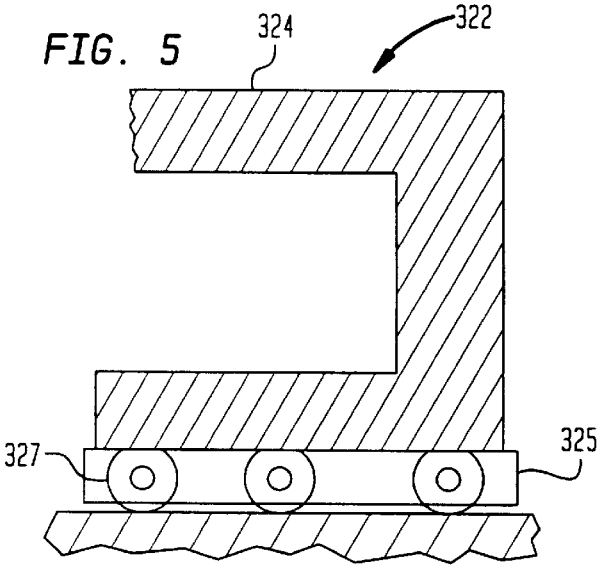
FIG. 5 is a variation of the cantilever beam as shown in FIGS. 4A and 4B, illustrating still a further embodiment of a cantilever beam which is portable.

FIG. 5 is a variation of the C-frame support 222 of FIGS. 4A and 4B. In this embodiment, the C-frame cantilevered support 322 is portable. That is, it may be placed on a cart 325, having wheels 327, so that it can be moved into and out of the finishing assembly 20 as needed. In addition, instead of lifting the non-conductive treatment assembly (discussed below) up and out of the way, the complete finishing assembly 322 can be rolled away.

As shown in FIG. 1, the pair of cantilever beams 24 and 26 are generally parallel to each other and extend in a direction transverse to the machine direction ("MD") of the finishing assembly 20. On the inside of both cantilever beams 24 and 26, there are supports 48 for supporting and detachably securing a portion of a non-contacting treatment assembly (discussed further below) to the inside of the cantilever beams 24 and 26. Attached to the outside of the first cantilever beam 24 is a roll supporting member 50 for supporting inside treatment roll 28. Attached to the outside of the second cantilever beam 26 is a releasable roll supporting member 52 for releasably supporting the inside treatment roll 30 to the cantilever beam 26 during the loading and unloading of the endless web 42. The cantilevered support 22 is necessary to allow the endless web to be loaded onto the finishing assembly 20 without interference with the various components which are secured to the pair of cantilevered beams 24 and 26. Thus, having a free end which supports the necessary treatment equipment facilitates the loading and unloading of the endless web 42 without substantial interference.

Although the above discussion discloses a cantilevered support 22 having at least two cantilever beams 24 and 26, it is to be appreciated that the present invention contemplates a cantilevered support having at least one cantilever beam. In this configuration, whatever would be supported by both cantilever beams, as discussed previously, would be thus supported by at least one of the beams instead of at least two. In addition, the cantilevered supports shown in FIGS. 2A to 5 are not drawn to scale in that the free end of the supports is relatively longer than that depicted in the Figures to accommodate the width of the rollers and non-contacting treatment assemblies which are supported therefrom.

The drop frame 34 is located below the floor 21 and is capable of being adjusted up and down by drive mechanism 35. The drop frame typically is raised out of the floor by the drive mechanism 35 after the endless web 42 has been loaded onto the finishing assembly 20. The drop frame 34 is raised so that it engages with the free end portion or portions (e.g., beams 24 and 26) of the cantilevered support 22 during treatment of the endless web. When the endless web needs to be unloaded, the drop frame 34 is retracted back into the floor 21. Thus, while the cantilever beams 24 and 26 can support the weight of a non-operational finishing assembly, when the assembly is operating, the loads are such that the beams typically should be supported by the drop frame 34. In addition to supporting the dead weight of the beams with their added loads, the drop frame 34 aids in preventing a downward deflection of the beams which may occur over their length due to the beams own weight. Thus, the drop frame 34 provides a rigid mount, that during a treatment operation, holds tolerances, for instance, to facilitate the endless web 42 to track properly and not roll off the edge of one of the rolls. Any conventional drive mechanism may be used to raise and lower the drop frame 34. By way of example, the drive mechanism may be a set of screw jacks, hydraulics or pneumatics.

The inside treatment roll 28 may be of any type which treats the endless web 42 by contact. In a preferred embodiment, inside treatment roll 28 is heated. Preferably, treatment roll 28 is heated by hot oil and is commonly referred to as an "inside hot oil roll." Alternatively, these treatment rolls may be steam heated rolls or electric heated rolls as well.

Inside treatment roll 28 is spaced apart from, and arranged parallel to, inside treatment roll 30 on either side of the cantilever beams 24 and 26. In a preferred embodiment, the inside treatment roll 30 is a stretch roll which may be removably mounted on the roll supporting member 52 for movement toward and away from the cantilevered support 22. This roll also may be heated as well. The inside treatment roll 30 is moved by means of the roll carriage device 43. It should be appreciated that these components such as, for example, the inside treatment rolls 28 and 30 and the movable roll carriage device 43 are of the conventional sort used in typical finishing assemblies similar to finishing assembly 20.

The outside treatment roll 36 is vertically moveable into and out of the finishing assembly 20, preferably into the transversely-extending open space 40. The outside treatment roll 36 can be of any type which is capable of treating the endless web 42 by contact and is typically of the conventional type similar to the inside hot oil roll 28 or the inside stretch roll 30. In a preferred embodiment, the outside treatment roll 36 is heated. Most preferably, the roll 36 is heated with hot oil and is commonly referred to as an "outside hot oil roll." This roll, like the inside rolls discussed above, may be heated by steam or electric heat.

In FIG. 1, the outside treatment roll 36 is shown contacting the endless web 42 over a predetermined contact surface area. Preferably, in this embodiment, the contact surface area ranges from between about a one degree arcuate sector of the outside treatment roll to about a 340 degree arcuate sector of contact surface area of the outside treatment roll, the latter being when the outside treatment roll 36 is in its upwardmost position between the cantilever beams 24 and 26. By way of example only, the endless web 42 may typically wrap around the outside treatment roll over about a 180 degree arcuate sector.

When the outside treatment roll 36 is not in operational position, it is stored in the recessed open space 38. The outside treatment roll 36 is raised and lowered from a first position to a second position by means of a drive mechanism 54. This drive mechanism may be any of any conventional type such as a screw jack, hydraulics, and the like.

The felt guide rolls or felt follower rolls 32*a* and 32*b* are placed adjacent the outside treatment roll 36 just below the diameter of the outside treatment roll. These felt guide rolls 32*a* and 32*b* act as force actuating mechanisms. That is, when the outside treatment roll 36 is moved into operational position, it creates an upward force against the endless web 42. This force is countered and regulated by the felt guide rolls 32*a* and 32*b* to maintain the proper contact surface area of the outside treatment roll 36 on the endless web 42. Included on the felt guide rolls 32*a* and 32*b* are backup rollers 33 which are used to further counter the upward forces of the outside treatment roll and to keep the felt guide rolls 32*a* and 32*b* in a relative operating position.

Although the felt follower or guide rolls 32*a* and 32*b* and backup rollers 33 are shown positioned at or just below the diameter of the outside treatment roll 36, it is to be appreciated that the follower rolls 32*a* and 32*b* may be adjusted below the center of the outside treatment roll and toward each other following the southern hemisphere of the outside treatment roll 36 until the follower rolls 32*a* and 32*b* almost touch. Along this path, it follows that there will be a larger wrap of the endless web 42 about the outside treatment roll 36, approaching a 360 degree arcuate sector. It should be appreciated that the guide rolls 32*a* and 32*b* also may be used to compress the endless web 42 as part of the overall treatment process.

In a first mode of operation, the finishing assembly 20 is prepared for an endless web to be loaded thereon. This is achieved by supporting the inside treatment roll 28 on roll supporting member 50 and the inside treatment roll 30 on roll supporting member 52. In addition, the drop frame 34 is lowered into the floor 21, the outside treatment roll 36 is lowered into recessed open space 38 and the roll carriage drive 43 is moved away from inside treatment roll 30. Although FIG. 1 shows inside treatment roll 28 as being rotatably fixed to supporting member 50, is should be appreciated that roll 28 may be removed after a loading of the endless web 42 in a similar fashion to the way the inside treatment roll 30 is removed.

Once the endless web 42 has been loaded onto the finishing assembly 20, the roll carriage drive 43 is moved toward the inside treatment roll 30 until it engages with the releasable roll supporting member 52. The outside treatment roll 30 is then moved from the roll supporting member 52 onto the roll carriage device 43. The carriage device 43 then moves horizontally away from the cantilevered support 22 to a predetermined distance or force depending on the type of process being performed and the size of the endless web 42. This movement of the inside treatment roll 30 effects a stretching of the endless web 42 to a certain predetermined extent which also adds to the treatment of the endless web.

Next, the outside treatment roll 36 is raised in a vertical direction such that it contacts the endless web over a predetermined contact surface area as described above. Also, the drop frame 34 is raised so that it contacts the bottoms of the free end of the cantilevered support 22. In this embodiment, the drop frame 34 contacts the cantilever beams 24 and 26 to provide support thereto.

Thus, during this particular mode of operation, the inside treatment roll 28 is heat treating the inside surface of the endless web 42 by contact, the inside treatment roll 30 is stretching the endless web 42 and the outside treatment roll 36 is heat treating the outside surface of the endless web by contact.

Figure 6:
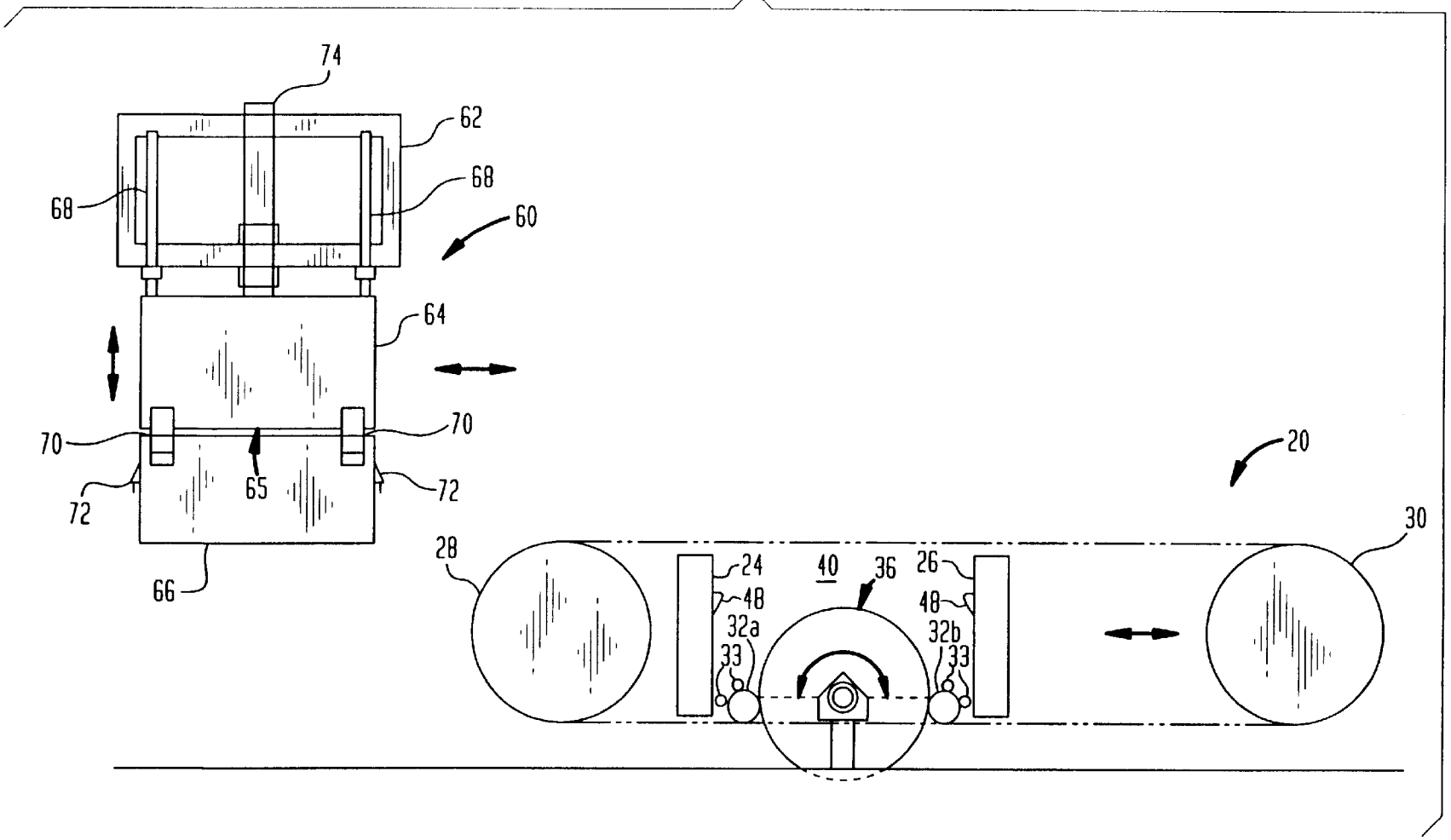
FIG. 6 is a schematic side elevation view of a finishing assembly such as shown in FIG. 1, with the addition of a non-contacting treatment assembly positioned in a non-operational or non-treatment position.
Figure 7:
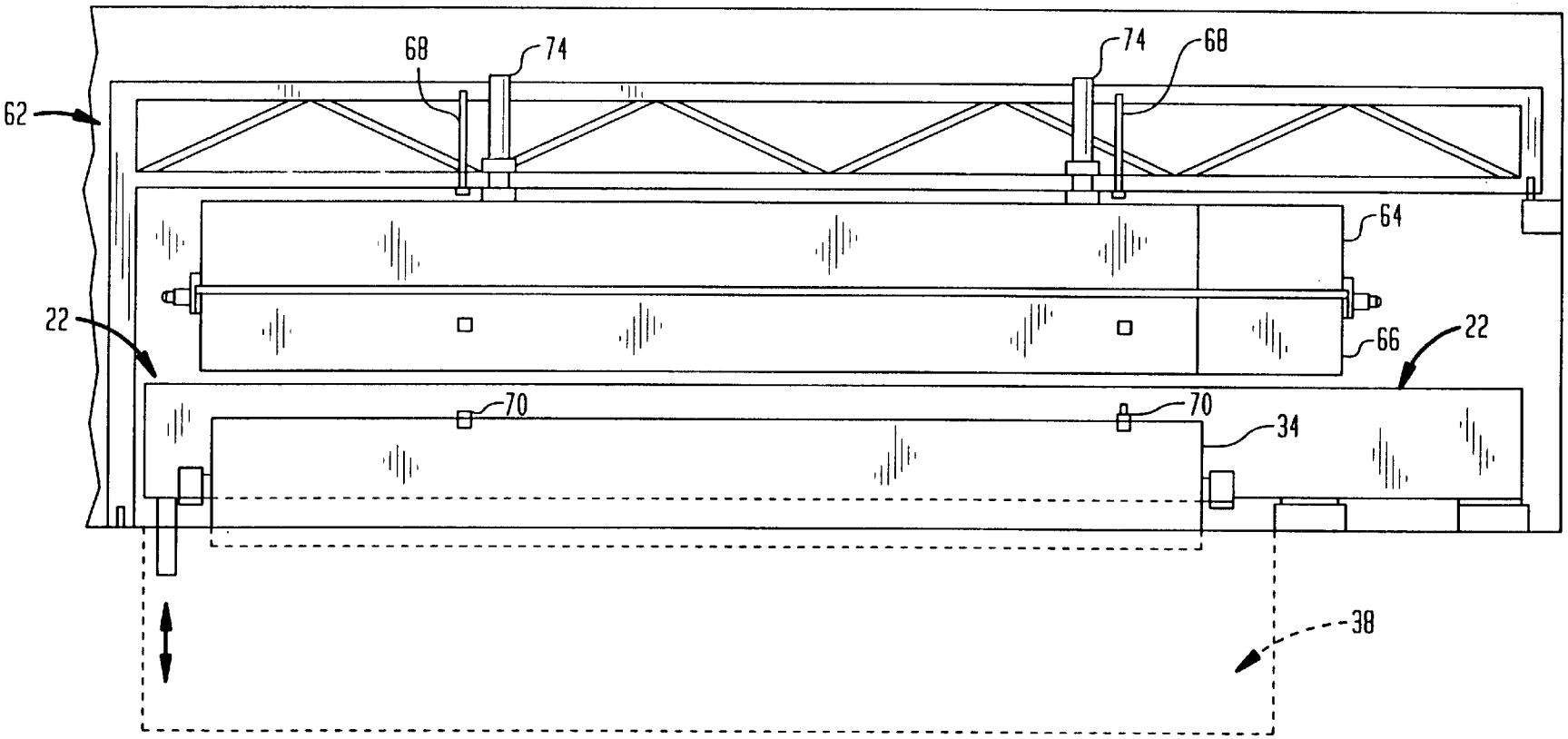
FIG. 7 is a schematic end elevation view of the finishing assembly as shown in FIG. 6.

In accordance with another aspect of the present invention, as shown in FIGS. 6 and 7, there is provided the finishing assembly 20 as shown in FIG. 1, with the addition of a non-contacting treatment assembly 60 which is shown in a non-operational or non-treatment position. Certain of the features of the finishing assembly 20 as shown in FIG. 1 are not shown in FIGS. 6 and 7 nor in the remaining Figures. However, it should be understood and appreciated that these features are included in the finishing assembly 20, but have not been shown in the remaining Figures for purposes of simplifying the drawings.

In this aspect of the present invention, the outside treatment roll 36 follows the same mode of operation as described above with respect to FIG. 1.

The non-contacting treatment assembly 60 comprises a support frame 62, a first transversely-extending housing 64 and a second transversely-extending housing 66 attached to the first housing 64. The first and second housings 64 and 66 define a horizontal gap 65 therethrough for allowing the endless web to move. The first housing 64 is attached to the support frame 62 with any mechanical or electromechanical vertical actuating mechanism. For example, the vertically adjustable securing members may be screw jacks 68. At least the first housing 64 is vertically guided by guides 74. The first housing 64 is preferably attached to the second housing 66 with securing fasteners such as docking pins 70. Also attached to the outside walls of the second housing 66 are supports 72 which correspond with supports 48 such that when the non-contacting treatment assembly 60 is in an operational or treatment position, supports 72 connect with supports 48 to secure the second housing 66 to the cantilevered support 22.

FIG. 7 illustrates the same configuration as shown in FIG. 6, but in side view. This side view reveals at least the extent of the support frame 62, first housing 64 and second housing 66. FIG. 7 also shows a portion of the cantilevered support 22.

Thus, FIGS. 6 and 7 show the finishing assembly 20 with both the outside treatment roll 36 and the non-contacting treatment assembly 60, where the outside treatment roll 36 is in operational position and the non-contacting treatment assembly 60 is positioned in a non-operational position. The operation of the finishing assembly 20 in this operation mode is similar to the operation described above except that the non-contacting treatment assembly 60 is included, albeit not in an operational position.

The first and second housings, 64 and 66, may be any type of housing which provides for treatment of the endless web 42 without contacting it. By way of example, these housings may comprise air boxes which circulate air through and around the endless web 42. The air in the air boxes may be heated. As an alternative to circulating air, the housings may provide a radiation energy source such as, for example, infrared, ultraviolet or microwave, which treat the endless web 42 without contacting it. In other embodiments, the housings may contain a chemical source, a steam heat source or a sonic energy source, such as mechanical vibrational energy or acoustic energy.

In a preferred embodiment, the non-contacting treatment assembly 60 comprises a heated air box set. For example, in a most preferred embodiment, this heated air box set may be an "Air Through Compact" heatset as manufactured by Alfsen og Gunderson AS of Norway ("AG"). The AG Air Through Compact is a double sided heatsetting system for drying fabrics, forming fabrics and press felts.

Figure 8:
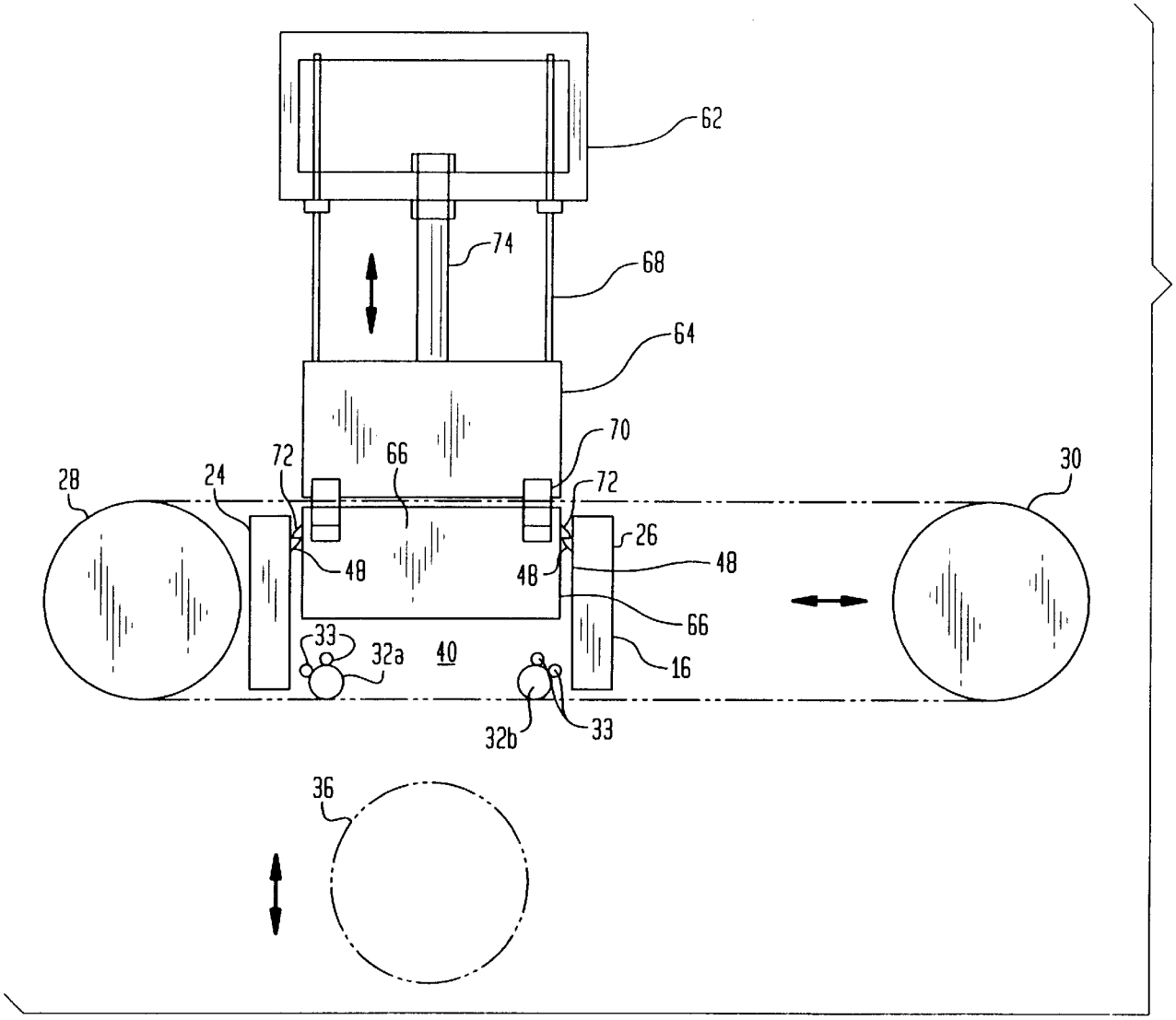
FIG. 8 is a schematic side elevation view of the finishing assembly of FIG. 6, illustrating the non-contacting treatment assembly in an operational or treatment position and the outside treatment roll in a non-operational or non-treatment position.
Figure 9:
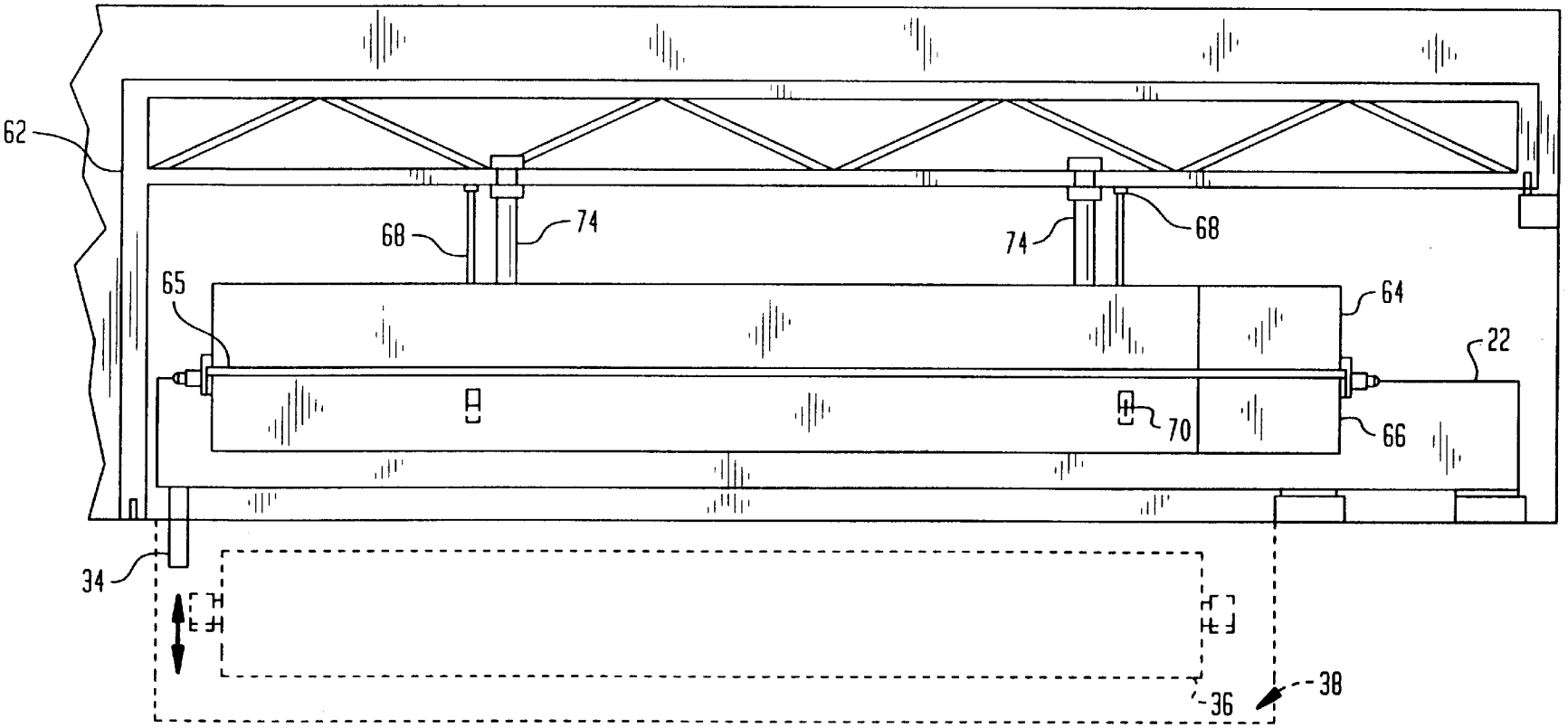
FIG. 9 is a schematic end elevation view of the finishing assembly of FIG. 8.

In another mode of operation, the non-contacting treatment assembly is moved from the position as shown in FIGS. 6 and 7 to the position as shown in FIGS. 8 and 9. In this mode of operation, the non-contacting treatment assembly 60 is set into place by the hoist mechanism as discussed above. That is, the first housing 64 is secured to the support frame 62 and the second housing 66 is secured to the first housing 64 as described above. Preferably, the assembly 60 is moved as a unit horizontally via a motorized rack and pinion drive (not shown) and vertically by the screw jacks 68 into and out of the transversely-extending open space 40, although any suitable X-Y drive mechanism would be within the scope of the present invention. Preferably, the screw jacks 68 also are motorized. Further, the outside treatment roll 36 is lowered into the recessed open space 38 in a non-operational position as discussed previously.

Once the housings 64 and 66 are moved into place, the bottom housing 66 is secured to the cantilevered support 22, preferably between cantilever beams 24 and 26. Then the top housing 64 is removed up and away to provide clearance for the loading of the endless web 42. Once the endless web is loaded, the top housing 64 is moved back into an operational position. Preferably, housing 64 is secured to housing 66 via docking pins 70.

Figure 10:
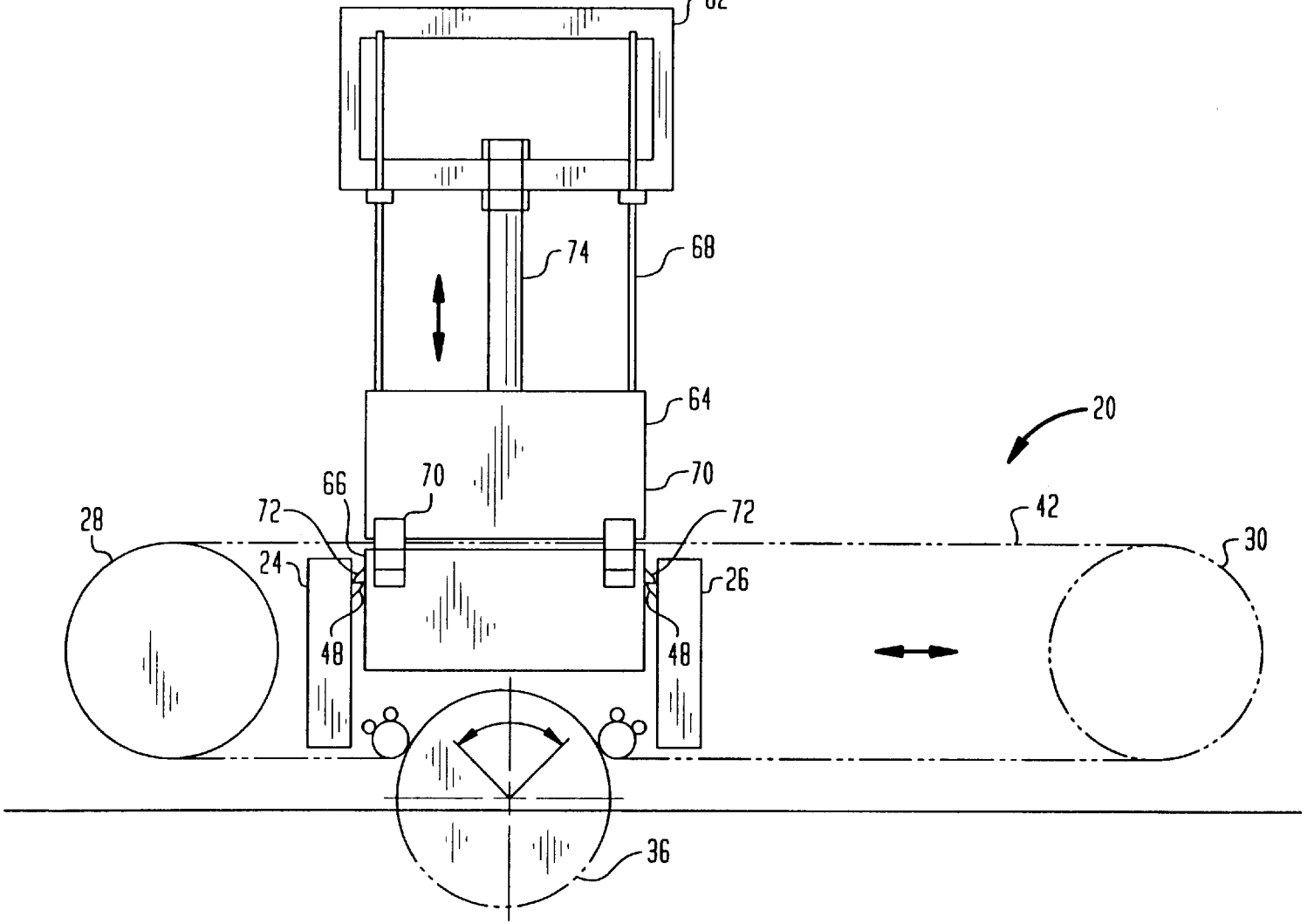
FIG. 10 is a schematic side elevation view of the finishing assembly of FIG. 6, illustrating both the outside treatment roll and the non-contacting treatment assembly in operational positions.
Figure 11:
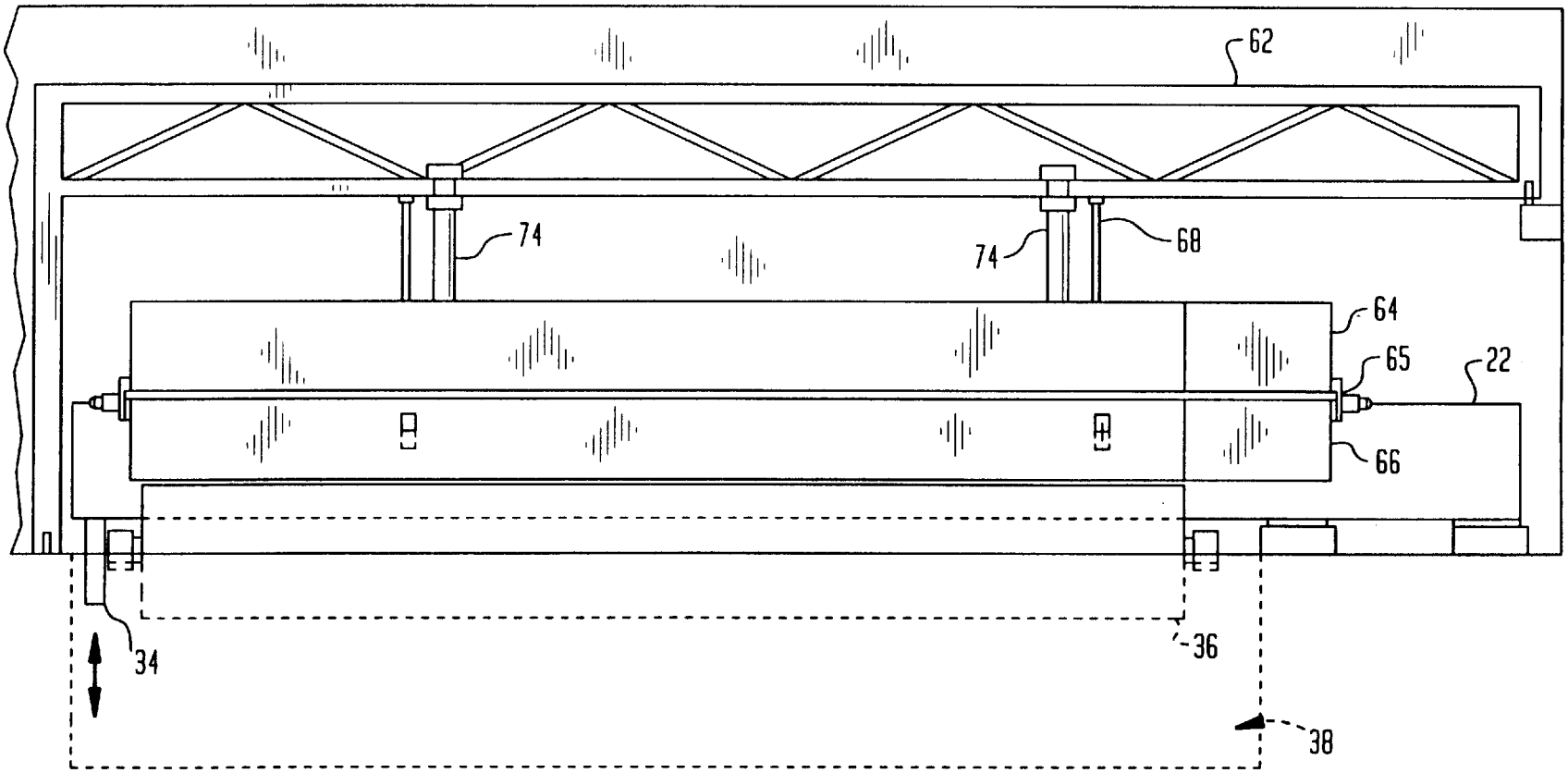
FIG. 11 is a schematic end elevation view of the finishing assembly as shown in FIG. 10.

In yet another embodiment of the present invention as shown in FIGS. 10 and 11, the finishing assembly 20 is shown where both the outside treatment roll 36 and the non-contacting treatment assembly 60 are in operational or treatment position. In this mode, the housings 64 and 66 treat the endless web 42 in combination with the outside treatment roll 36. In this configuration, the predetermined contact surface area is between about a one degree and about a 320 degree arcuate sector. By way of example, the predetermined contact surface area can be about an 80 degree arcuate sector.

Figure 12:
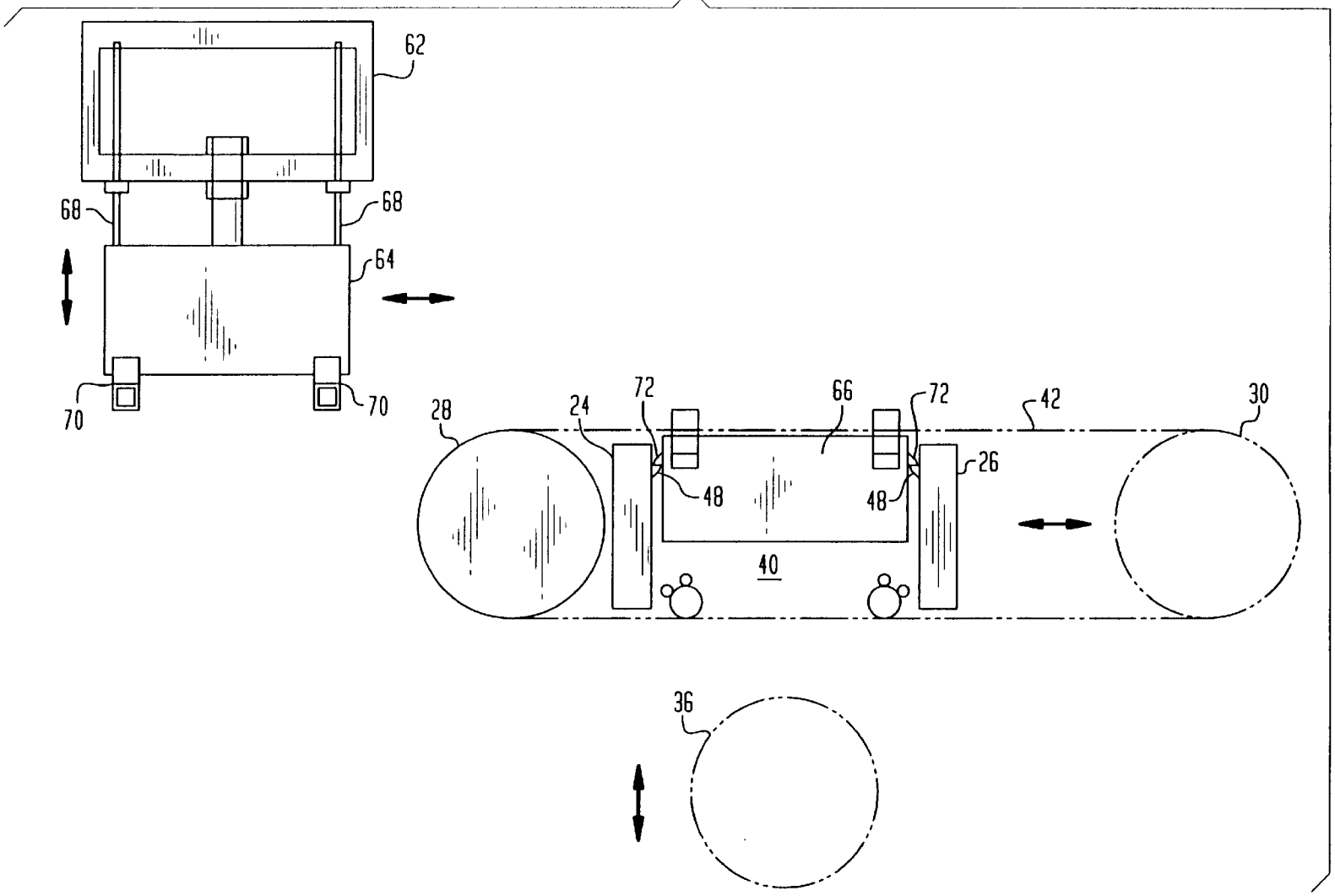
FIG. 12 is a schematic side elevation view of the finishing assembly of FIG. 6, illustrating the bottom housing of the non-contacting treatment assembly secured to the cantilevered support.
Figure 13:
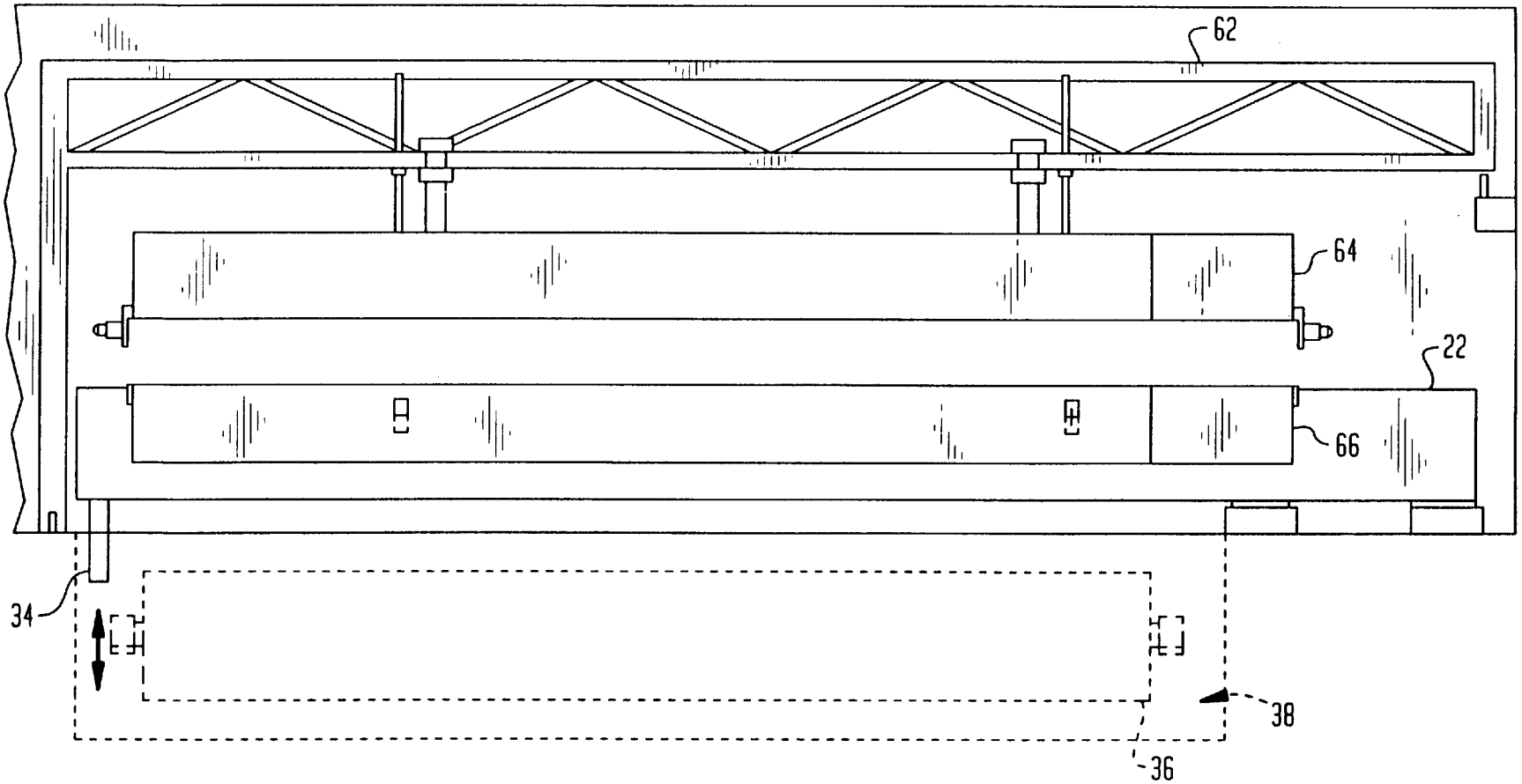
FIG. 13 is a schematic end elevation view of the finishing assembly of FIG. 12.

In another alternative embodiment as shown in FIGS. 12 and 13, the second housing 66 is secured to the cantilevered support 22 while the first housing 64 is hoisted away independently. This allows for the endless web 42 to be loaded onto the finishing assembly 20 while the second housing 66 remains between the cantilever beams 24 and 26.

In accordance with another aspect of the present invention, as shown in FIGS. 14 through 27, there is provided the finishing assembly 20 similar to the one shown in FIG. 1, with the substitution of a pivotable cantilever beam assembly 400 for the cantilever beam 26. Certain of the features of the finishing assembly 20 as shown in FIG. 1 are not shown in FIG. 14 nor in the remaining Figures. However, it should be understood and appreciated that these features are included in the finishing assembly 20, but have not been shown in the remaining Figures for purposes of simplifying the drawings.

Figure 14:
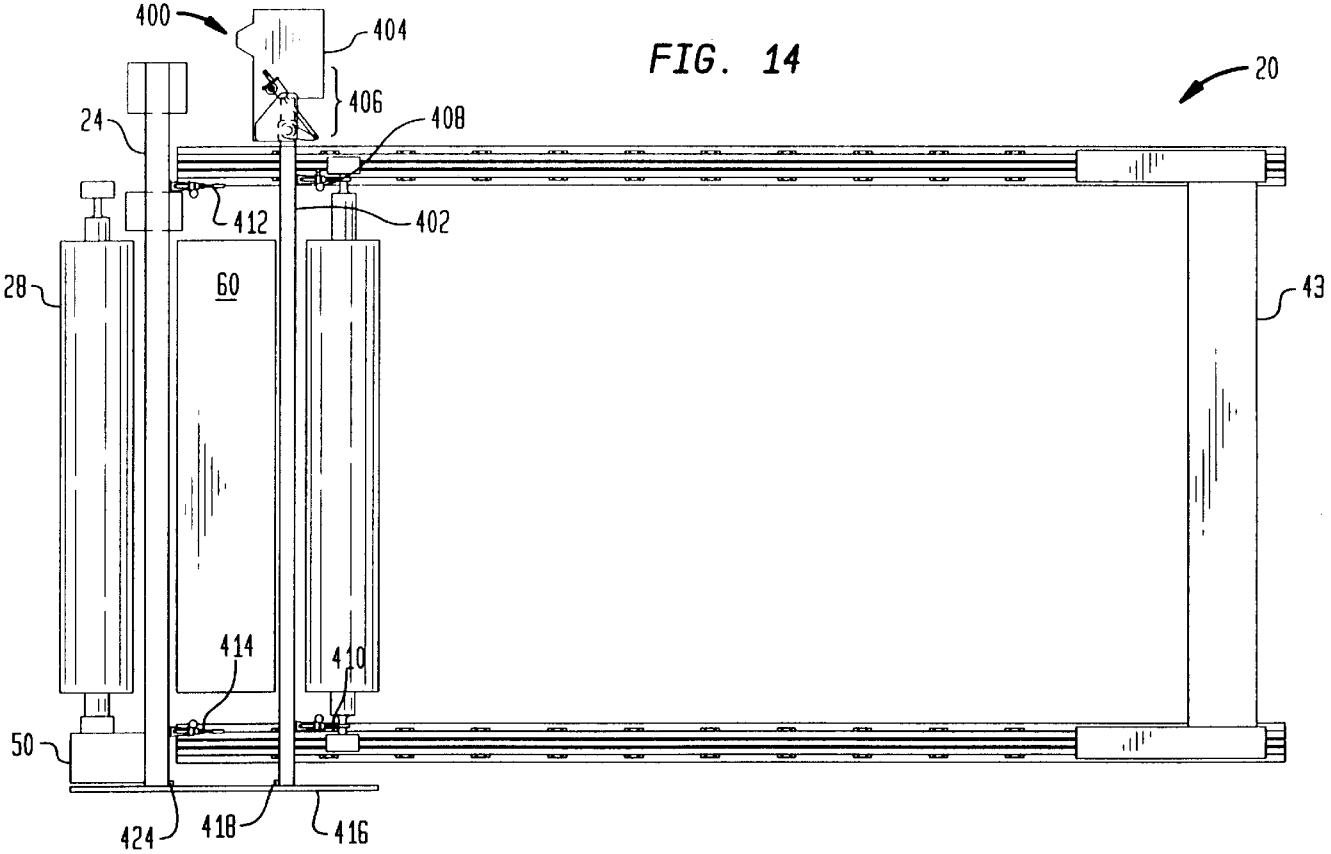
FIG. 14 is a schematic top plan view of the finishing assembly in accordance with another embodiment of the present invention, illustrating the finishing assembly with the pivotable cantilever beam in its first position.

In FIG. 14, the pivotable cantilever beam assembly 400 is in a first position, in which a pivotable cantilever beam 402 is transverse to the machine direction of the endless web 42. The pivotable cantilever beam 402 is connected to a stationary support 404 by a mounting assembly 406. The pivotable cantilever beam has a first roll supporting device 408 and a second roll supporting device 410 attached to the beam 402 such that the first and second roll support devices can support the inside treatment roll 30. The cantilever beam 24 has a third roll supporting device 412 and a fourth roll supporting device 414 attached to it such that the third and fourth roll support devices can support the inside treatment roll 30. At the end of the pivotable cantilever beam 402 is a tie plate 416. The tie plate 416 is attached to the pivotable cantilever beam 402 by a hinge 418 (see FIG. 17), which locks the pivotable cantilever beam 402 to the cantilever beam 24 via the tie plate connector 424.

Figure 15:
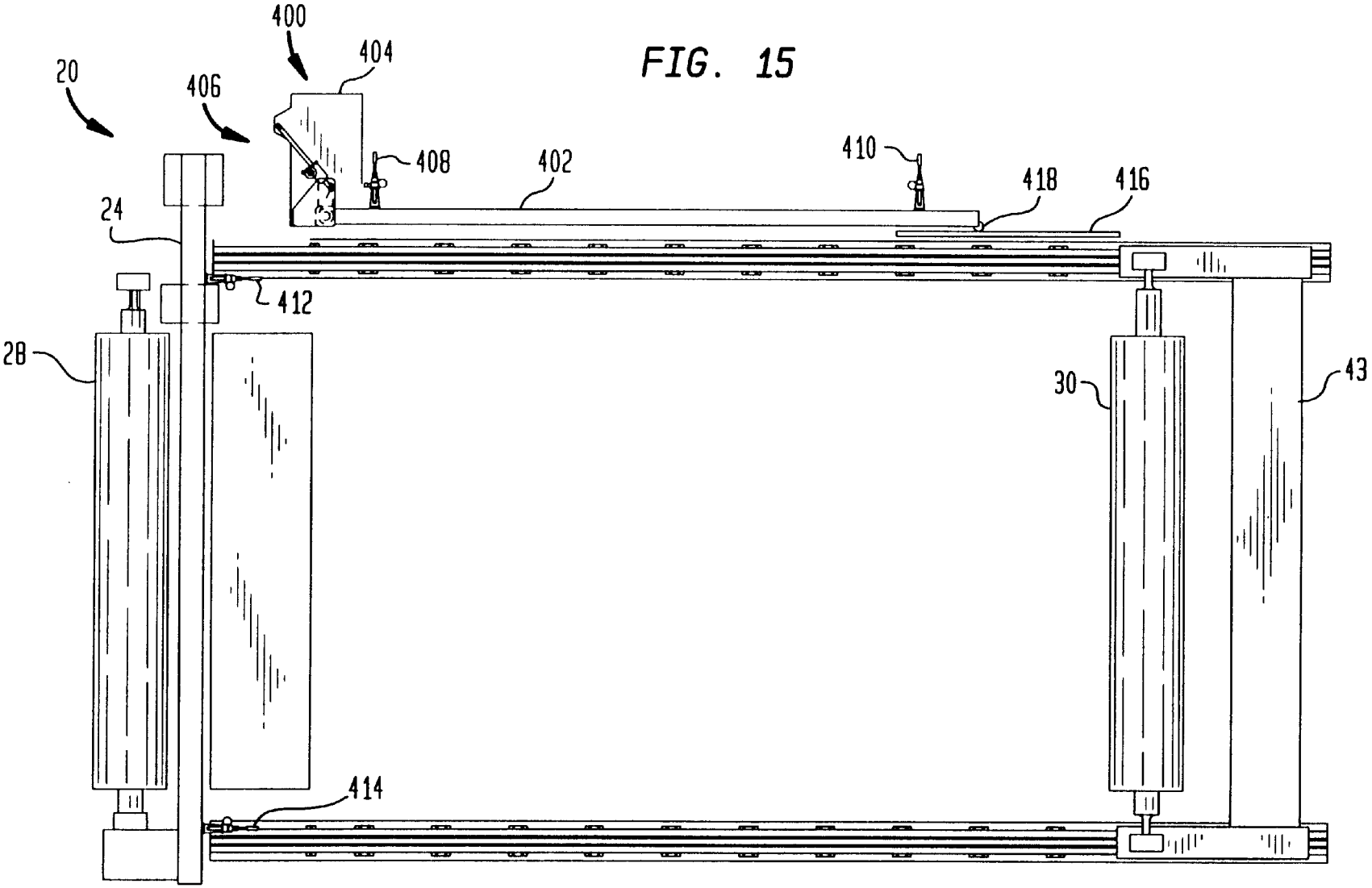
FIG. 15 is a schematic top plan view of the finishing assembly of FIG. 14 illustrating the finishing assembly with the pivotable cantilever beam in its second position.

As best shown in FIG. 15, the pivotable cantilever beam 402 is in a second position, in which the pivotable cantilever beam 402 is outside the lateral extent of the endless web 42. The tie plate 416 is shown rotated on the tie plate hinge 418 such that the tie plate is also outside the lateral extent of the endless web 42.

Figure 16:
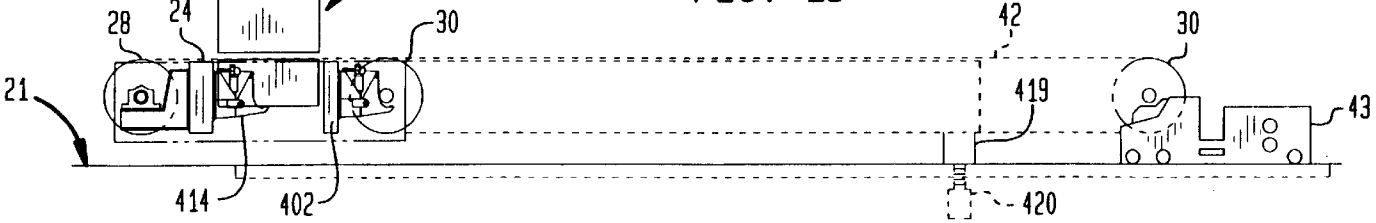
FIG. 16 is a schematic side elevation view of the finishing assembly as shown in FIG. 14.

In FIG. 16, the pivotable cantilever beam 402 is shown in its first position, and in phantom in its second position. In the second position, the pivotable cantilever beam 402 is supported by a block 419 which is adjustable by a vertical actuator 420. The block 419 helps to prevent excessive bowing of the pivotable cantilever beam 402. The vertical actuator 420 is partially below ground level, and raises to support the block 419 which is turn supports the pivotable cantilever beam 402 after the beam has swung into its second position.

Figure 17:
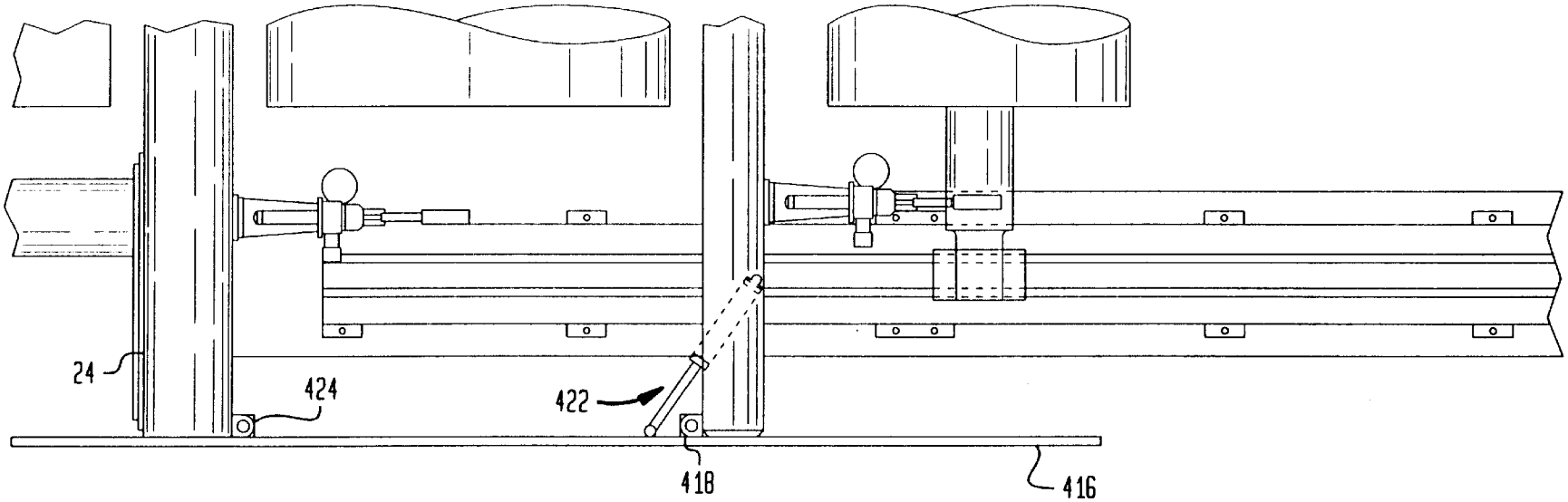
FIG. 17 is a schematic top plan partial view of the finishing assembly as shown in FIG. 14, illustrating the locking mechanism between the fixed cantilever beam and the pivotable cantilever beam.

In FIG. 17, the locking mechanism provided by the tie plate 416 is shown in detail. The tie plate 416 can be rotated about the tie plate hinge 418 by a tie plate actuator 422. The tie plate 416 is fixed to the cantilever beam 24 by a tie plate connector 424.

Figure 18:
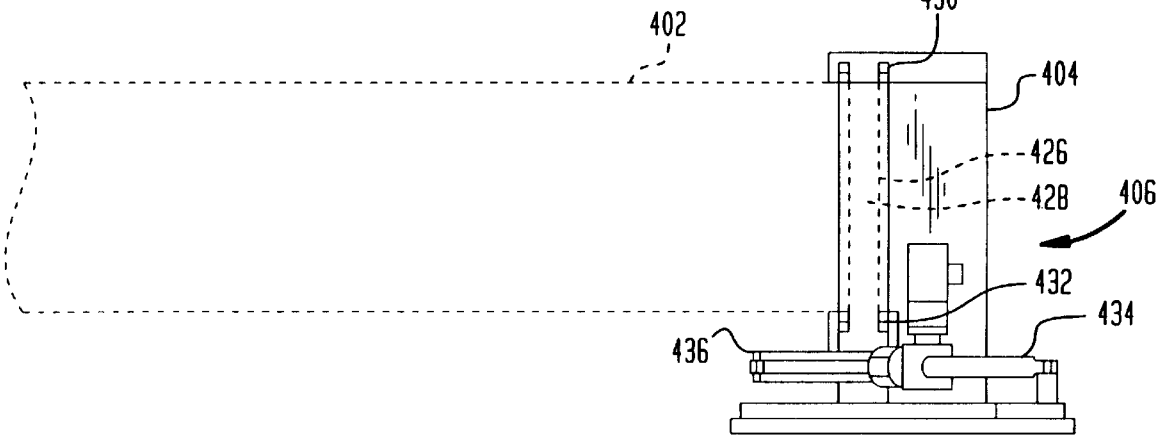
FIG. 18 is a schematic side view of the mounting assembly of the pivotable cantilever beam of the finishing assembly as shown in FIG. 14.

In FIG. 18, the mounting assembly 406 which connects the stationary support 404 to the pivotable cantilever beam 402 is shown as viewed from the side transverse to the machine direction in more detail. Here, the pivotable cantilever beam 402 is in its first position. A hole 426 extends through the pivotable cantilever beam 402, through which a pin 428 extends. The pin 428 is held by an upper tapered roller bearing 430 and a lower tapered roller bearing 432. The pin 428 also is attached to an actuator 434 by an arm 436.

Figure 19:
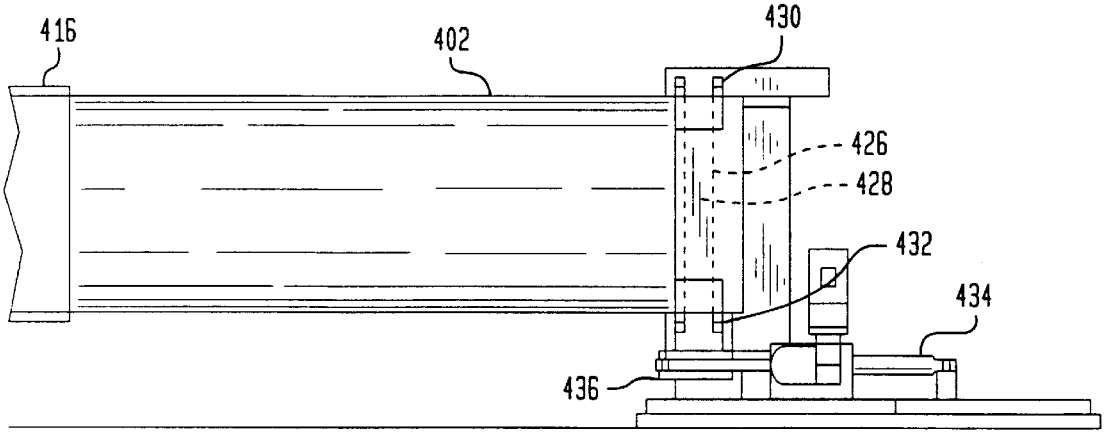
FIG. 19 is another schematic side view of the mounting assembly of the pivotable cantilever beam, in accordance with FIG. 14.

FIG. 19 shows the mounting assembly in the first position as viewed along the machine direction. Again, the mounting assembly 406 which connects the stationary support 402 to the pivotable cantilever beam 404 is shown in more detail. The pivotable cantilever beam 402 is in its first position. A hole 426 extends through the pivotable cantilever beam 402, through which a pin 428 extends. The pin 428 is held by an upper tapered roller bearing 430 and a lower tapered roller bearing 432. The pin 428 also is attached to an actuator 434 by an arm 436.

Figure 20A:
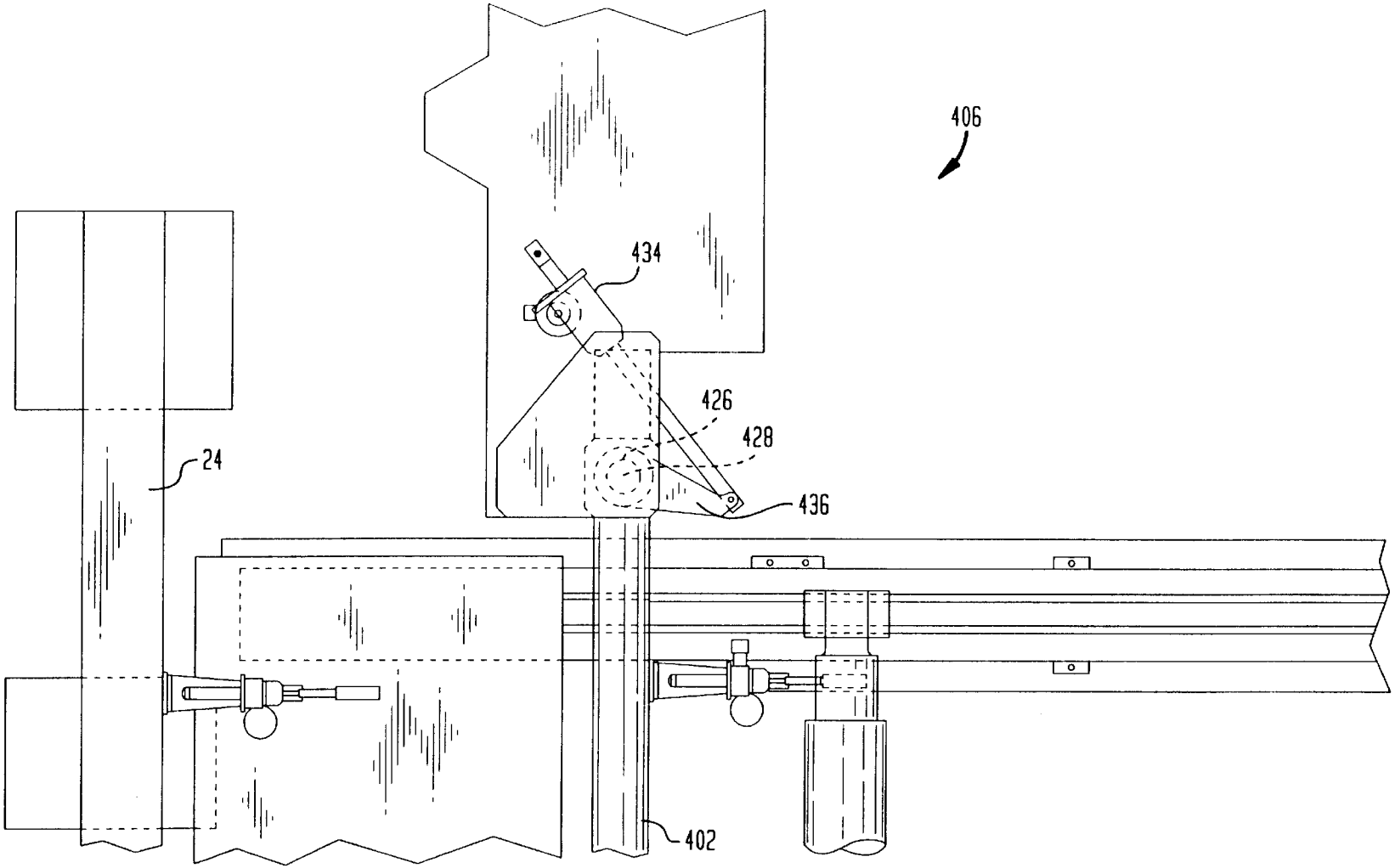
FIG. 20A is a schematic top plan partial view of the mounting assembly of the pivotable cantilever beam of the finishing assembly of FIG. 14, illustrating the mounting assembly when the pivotable cantilever beam is in its first position.

In FIG. 20A, the mounting assembly 406 is shown from a top view with the pivotable cantilever beam 402 in the first position. The pin 428 is fixedly attached to the arm 436 such that when the arm 436 moves so does the pin 428, and thus so does the pivotable cantilever beam 402. The pin 428 is attached to the actuator 434 such that they can rotate with respect to each other.

Figure 20B:
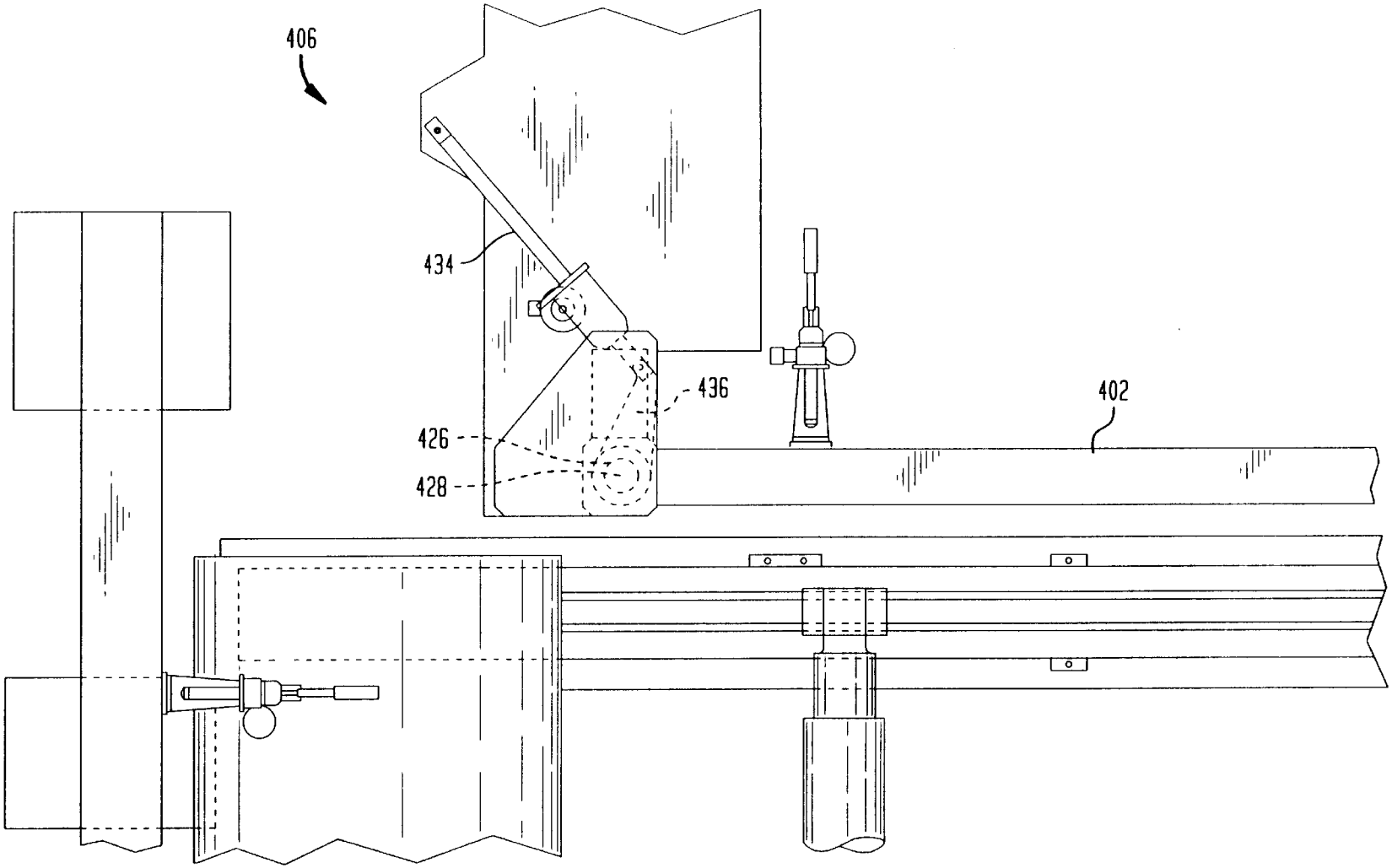
FIG. 20B is a schematic top plan partial view of the mounting assembly of the pivotable cantilever beam of the finishing assembly of FIG. 15, illustrating the mounting assembly when the pivotable cantilever beam is in its second position.

FIG. 20B shows the mounting assembly 406 in a top view with the pivotable cantilever beam in the second position. The actuator 434 is shortened, pivoting the arm 436 around the hole 426. This, in turn, moves the pin 428, which, in turn, moves the pivotable cantilever beam 402.

Figure 28:
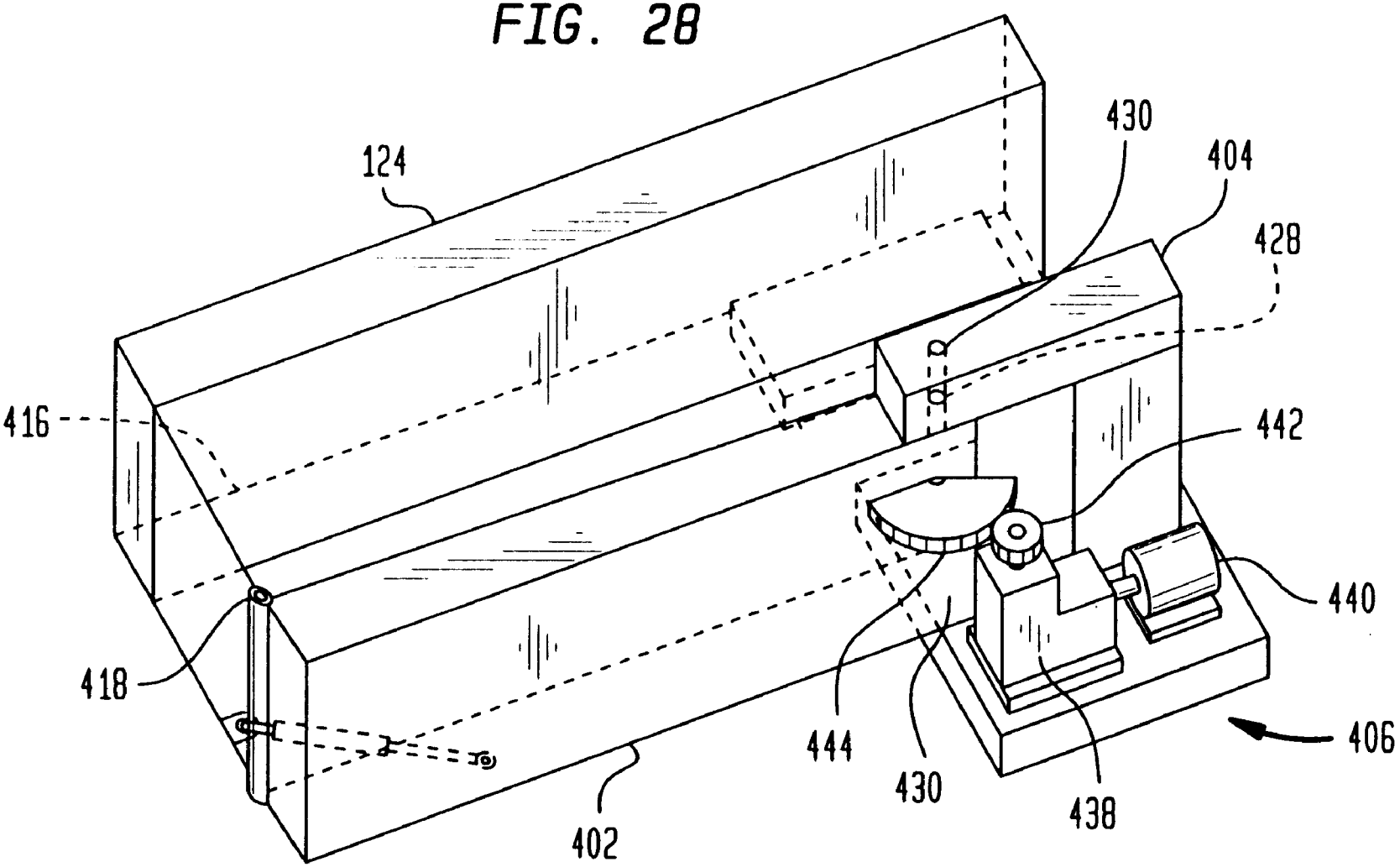
FIG. 28 is a schematic isometric view of another alternative embodiment of the finishing assembly, illustrating a drive actuator.

An alternative embodiment of the mounting assembly 406 is shown in FIG. 28. In this embodiment, the mounting assembly 406 retains the hole 426 through the supported end of the pivotable cantilever beam 402, the pin 428 which passes through the hole 424 (not shown) and which is attached to the pivotable cantilever beam 402, and the upper and lower tapered roller bearings 430 and 432. The pivotable cantilever beam 402 is pivoted by a gear drive 438, which is, in turn, driven by a gear motor 440. The gear drive 438 rotates a drive gear 442. A beam gear 444 is attached to the pivotable cantilever beam 402 in such a way that the beam gear 444 meshes with the drive gear 442. Thus the beam gear drive 438 can move the pivotable cantilever beam 402.

Figure 21:
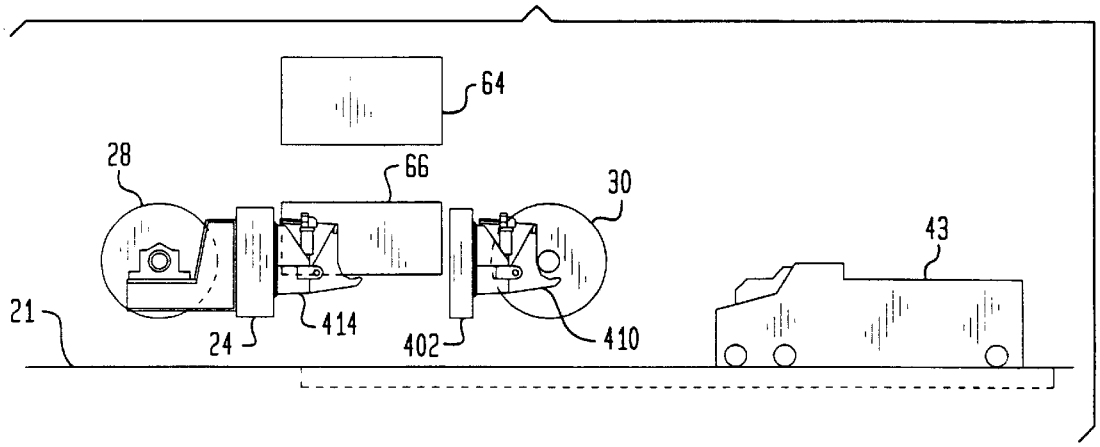
FIG. 21 is a schematic side view of the finishing assembly of FIG. 14, illustrating the conversion of the finishing assembly from two beam operation to one beam operation.

In operation, the pivotable cantilever beam 402 moves from a first position transverse to the machine direction to a second direction outside the lateral extent of the endless web 42. This conversion is illustrated in FIGS. 21 through 27. In FIG. 21, the pivotable cantilever beam 402 is shown in its first position just after the endless web 42 has been removed. The inside treatment roll 30 is mounted on the first roll supporting device 408 and the second roll supporting device 410. The movable roll carriage device 43 is moved away from the inside treatment roll 30. The first transversely-extending housing 64 and the second transversely-extending housing 66 are both in position to treat the endless web 42.

Figure 22:
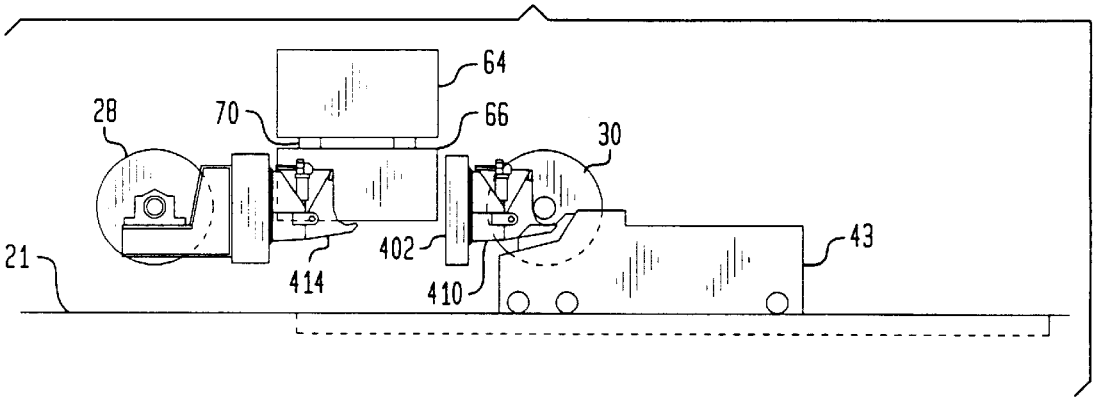
FIG. 22 is a schematic side view of the finishing assembly of FIG. 14, further illustrating the conversion of the finishing assembly from two beam operation to one beam operation.

In FIG. 22, the first transversely-extending housing 64 attaches to the second transversely-extending housing 66 with securing fasteners such as docking pins 70. The movable roll carriage device 43 has moved towards the pivotable cantilever beam 402 to a position under the inside treatment roll 30 in order to accept the inside treatment roll 30 from the first roll supporting device 408 (not shown) and the second roll supporting device 410.

Figure 23:
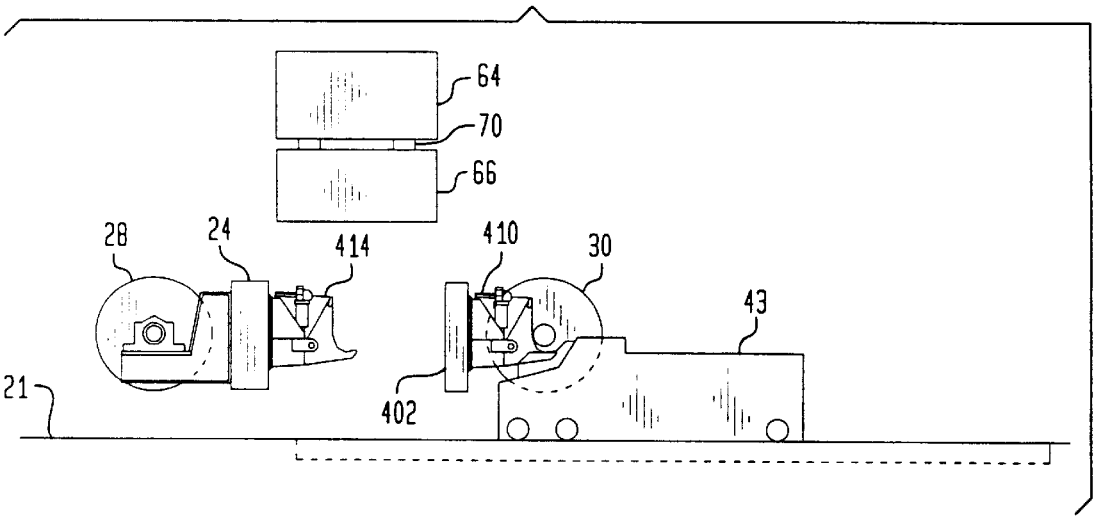
FIG. 23 is a schematic side view of the finishing assembly of FIG. 14, further illustrating the conversion of the finishing assembly from two beam operation to one beam operation.

In FIG. 23, the first transversely-extending housing 64, attached to the second transversely-extending housing 66, is moved vertically out of the way.

Figure 24:
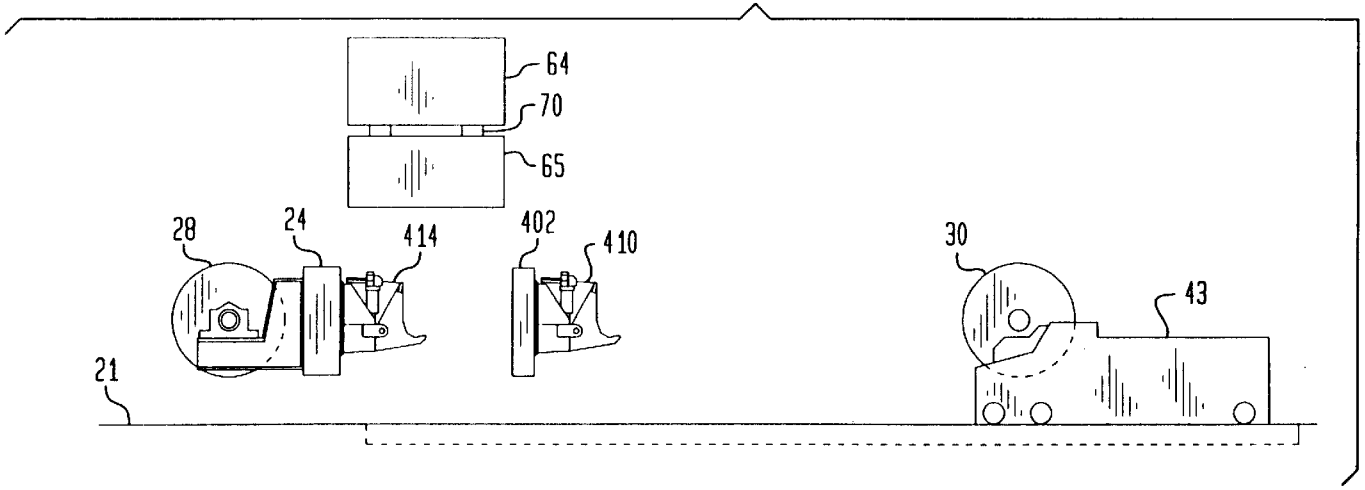
FIG. 24 is a schematic side view of the finishing assembly in of FIG. 14, further illustrating the conversion of the finishing assembly from two beam operation to one beam operation.

In FIG. 24, the movable roll carriage device 43 has moved away from the pivotable cantilever beam 402 with the inside roll 30.

Figure 25:
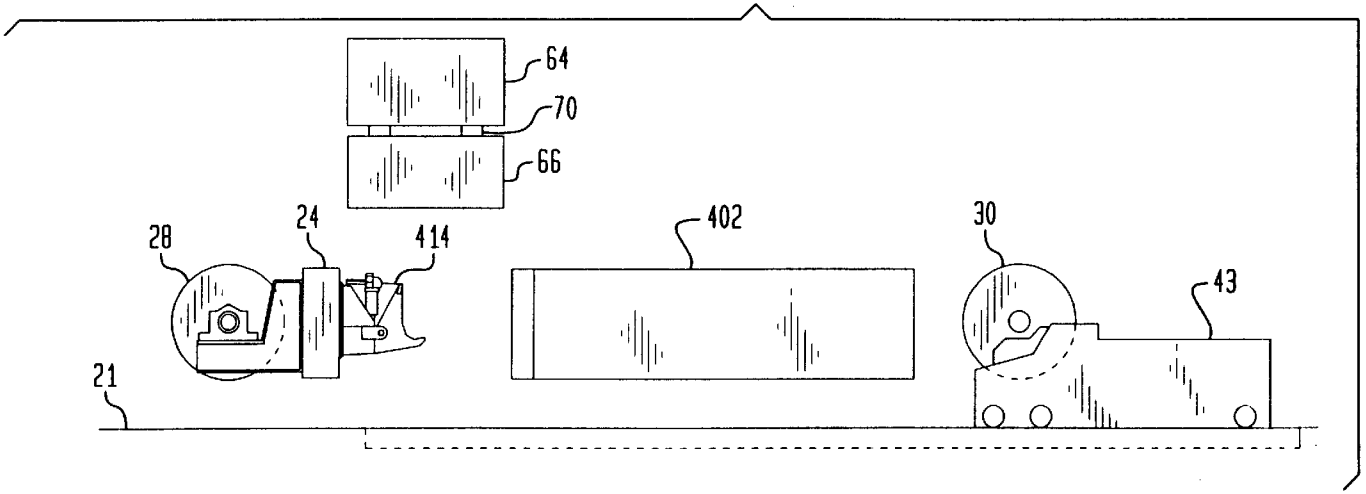
FIG. 25 is a schematic side view of the finishing assembly of FIG. 15, further illustrating the conversion of the finishing assembly from two beam operation to one beam operation.

In FIG. 25, the pivotable cantilever beam 402 has been rotated from the first position to the second position. The movable roll carriage device 43 has been pulled back far enough that it does not interfere with the pivotable cantilever beam 402.

Figure 26:
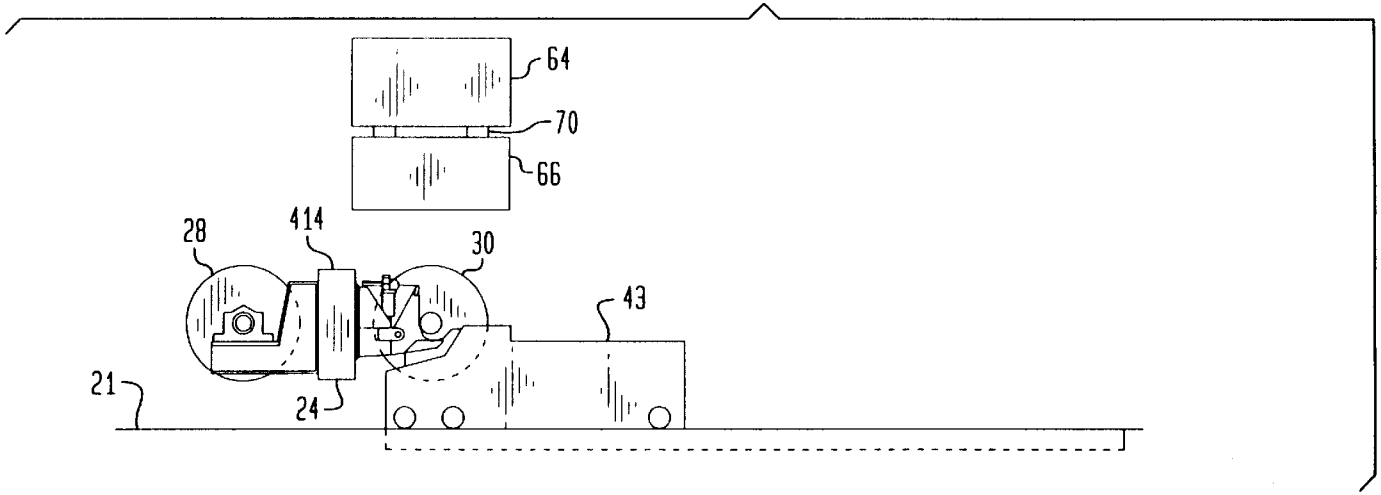
FIG. 26 is a schematic side view of the finishing assembly of FIG. 15, further illustrating the conversion of the finishing assembly from two beam operation to one beam operation.

In FIG. 26, the movable roll carriage device 43 has moved under the third roll supporting device 412 and the fourth roll supporting device 414. Both devices 412 and 414 are attached to the fixed cantilever beam 24. This transition allows for the transfer of the inside treatment roll 30 from the movable roll carriage device 43 to the third roll supporting device 412 and the fourth roll supporting device 414.

Figure 27:
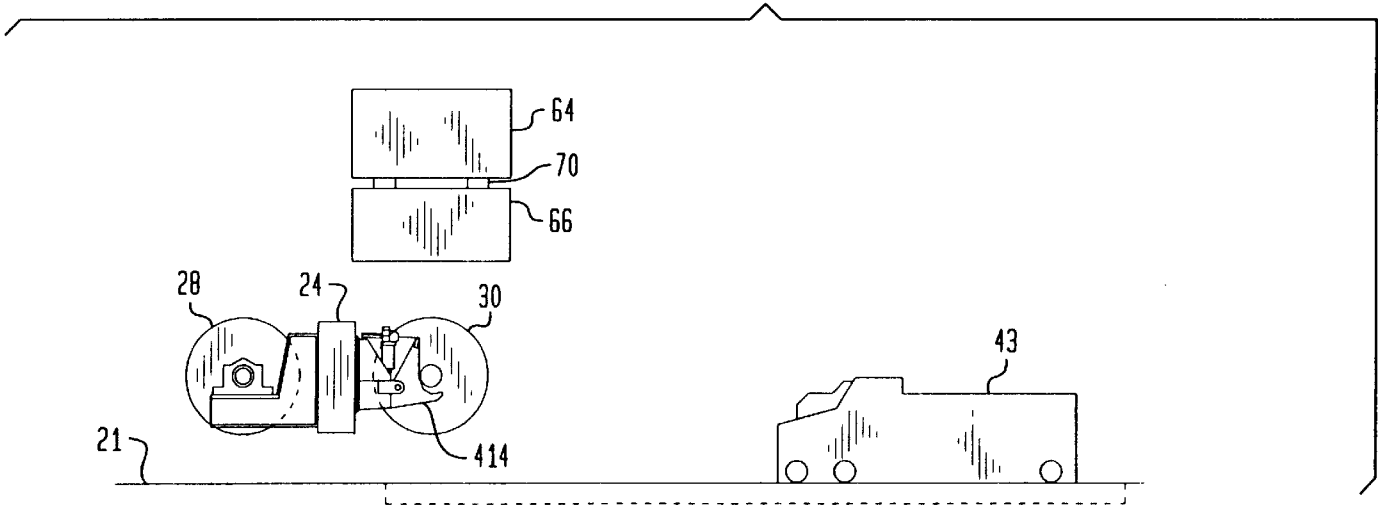
FIG. 27 is a schematic side view of the finishing assembly of FIG. 15, further illustrating the conversion of the finishing assembly from two beam operation to one beam operation.

In FIG. 27, the movable roll carriage device 43 has been moved away from the cantilever beam 24, leaving the inside treatment roll 30 on the third roll supporting device 412 and the fourth roll supporting device 414. This leaves both inside treatment rolls 28 and 30 attached to a single cantilever beam 24, which allows a shorter "minimum loop length" of the endless web 42 to be place on the finishing assembly 20. Both the movable roll carriage device 43 and the first transversely-extending housing 64 attached to the second transversely-extending housing 66 are in position to allow such an endless web 42 to be placed on the finishing assembly 20.

It will be appreciated by those skilled in the art that the pivotable cantilever beam 402, the arm 436, the tie plate 416, and other parts of the this embodiment may be made of any material capable of withstanding the weights and stresses placed upon it. By way of example, such materials could include steel, steel alloy, aluminum, composite material, or any other material capable of performing the required tasks.

It will be appreciated by those skilled in the art that the stationary support 404 could be built with any material capable of withstanding the weights and stresses placed upon it. Such materials could include concrete, reinforced concrete, steel, or any other material capable of performing the required tasks.

It will be appreciated by those skilled in the art that the actuator 434 and the tie plate actuator 422 can be any machine capable of delivering the necessary linear force. Such force could be mechanical, pneumatic, hydraulic, electromechanical or electromagnetic in nature. In its preferred embodiment, the actuators are screwjacks.

Although the present invention has been described in considerable detail with reference to certain preferred embodiments thereof, other examples are possible. For example, the pivotable cantilever beam 402 may be moved out of the way of the endless web 42 by any number of means. Specific alternative embodiments include, but are not limited to: suspending the pivotable cantilever beam 402 from the ceiling and hoisting it up vertically, placing the pivotable cantilever beam 402 on a track and moving it out of the way of the finishing machine on the track, and pivoting the pivotable cantilever beam in any dimension other that a horizontal plane. Any of these embodiments accomplish the task of moving the pivotable cantilever beam 402 out of the way so that a shorter "minimum loop length" endless web 42 can be loaded onto the finishing assembly 20.

Thus, the present invention provides many advantages over the prior art. By way of example, one of many advantages of the present invention is that the endless web 42 may be treated both on its inside surface and its outside surface without the need for felt turning. Another advantage is that this processing is achieved while maintaining the smallest "minimum loop length" possible. This is so preferable because the outside treatment roll 36 is positioned between the cantilever beams 24 and 26. Therefore, no additional linear length is needed to make room for the outside treatment roll 36, for instance, between one of the two inside treatment rolls 28 and 30 and the outside of the respective cantilever beam 24 and/or 26.

Another example of the many advantages of the present invention is that since the non-contacting treatment assembly is movable into and out of that part of the finishing assembly 20 where the endless web 42 is treated, it facilitates different finishing processes. Having the combination of non-contacting treatment assemblies and outside treatment rolls provides for a very smooth web or felt. That is, just having ovens, for example, would leave the felt rougher than what is desired at least for the outside (i.e., paper side) surface. Adding the outside treatment roll acts like an iron, which smoothes out any remaining rough spots or imperfections in the web.

Thus, the combination of non-contacting treatment assemblies such as ovens, and outside treatment rolls provides for an ideally treated web or felt. The added advantage of this aspect of the present invention is that the combination preserves the "minimum loop length" in the process.

Moreover, the present invention includes a finishing assembly which provides for increased dwell time for processing the webs without increasing the "minimum loop length." Also, if it is desirable to reduce the dwell time, one could speed up or increase the processing speed time. This results in broader ranges of processing techniques and enhanced overall manufacturing yields. In essence, the present invention provides for one assembly which is capable of performing many different processes and permutations while preserving the "minimum loop length."

Another example of the many advantages of the present invention is the ability to accept a shorter "minimum loop length" in an endless web 42 by including a pivotable cantilever and moving the beam 402 to its second position. This allows both inside treatment rolls to be suspended from a single cantilever beam 28 during web loading. Once this has been done, the various treatment may be applied to this shorter endless web 42.

While the foregoing description illustrates preferred embodiments of the various finishing assembly configurations in accordance with the present invention, it should be appreciated that the invention also covers various permutations of the foregoing described features, and that certain modifications may be made in the foregoing without departing from the spirit and scope of the present invention which is defined by the claims set forth immediately hereafter.

What is claimed is:

1. A finishing assembly for treating an endless web, said finishing assembly having a machine direction along which said endless web extends when loaded onto said finishing assembly, said finishing assembly comprising:

a. a cantilevered support comprising a fixed cantilever beam and a pivotable cantilever beam, said fixed cantilever beam extending in a generally horizontal direction transverse to the machine direction of said finishing assembly and having a supported end and a free end, and said pivotable cantilever beam extending in a generally horizontal direction and being pivotably mounted so as to be rotatable between a first position in which said pivotable cantilever beam extends in a direction generally transverse to the machine direction of said finishing assembly and a second position in which said pivotable cantilever beam extends in a direction generally parallel to the machine direction of said finishing assembly, such that said fixed cantilever beam and said pivotable cantilever beam when in said first position defining a transversely-extending open space therebetween;

b. first and second inside treatment rolls for contacting the inside surface of the endless web to treat the endless web, at least one of said inside treatment rolls being movable between an endless web loading position and an endless web treatment position, said inside treatment rolls being arranged to be supported on at least one of said cantilevered beams when said at least one of said inside treatment rolls is in said endless web loading position, and said at least one of said inside treatment rolls being spaced from said fixed cantilevered beam in a direction generally parallel to the machine direction when said at least one of inside treatment rolls is in said endless web treatment position; and c. a movable roll carriage device for moving said at least one of said inside treatment rolls between said loading position and said treatment position.

2. The finishing assembly of claim 1, wherein said pivotable cantilever beam has a supported end and a free end; and wherein said finishing assembly further includes a stationary support; and a mounting assembly for pivotably connecting said supported end of said pivotable cantilever beam to said stationary support.

3. The finishing assembly of claim 2, wherein said pivotable cantilever beam has an opening through the supported end of said pivotable cantilever beam; and wherein said mounting assembly further comprises:

a. a rotatably supported pin extending through said opening of said pivotable cantilever beam and connected to said pivotable cantilever beam such that said pivotable cantilever beam and said pin rotate together; and b. an upper bearing and a lower bearing, wherein an upper end of said pin is mounted within said upper bearing, and a lower end of said pin is mounted within said lower bearing.

4. The finishing assembly of claim 3, wherein said mounting assembly further comprises an actuator assembly carried by said stationary support and operatively connected to said pivotable cantilever beam.

5. The finishing assembly of claim 4, wherein said actuator assembly comprises a gear actuator.

6. The finishing assembly of claim 5, wherein said gear actuator comprises: a gear motor;

a. a gear drive driven by said gear motor;

b. a drive gear driven by said gear drive;

c. a beam gear attached to said pivotable cantilever beam, and meshing with said drive gear.

7. The finishing assembly of claim 4, wherein said actuator assembly of said mounting assembly further comprises:

a. an actuator having a first end attached to said stationary support and a second end; and b. an arm operatively connected to said pivotable cantilever beam and connected to said second end of said actuator, such that said arm is movable between a first actuation position in which said pivotable cantilever beam is in said first position and a second actuation position in which said pivotable cantilever beam is in said second position.

8. The finishing assembly of claim 7, wherein said actuator is a screw jack.

9. The finishing assembly of claim 7, wherein said actuator is hydraulic.

10. The finishing assembly of claim 7, wherein said actuator is a pneumatic actuator.

11. The finishing assembly of claim 7, wherein said actuator is an electromechanical actuator.

12. The finishing assembly of claim 7, further including a vertically movable support for supporting said free end of said pivotable cantilever beam when said pivotable cantilever beam is in said second position.

13. The finishing assembly of claim 12, wherein said vertically movable support is a vertical screw jack.

14. The finishing assembly of claim 12 wherein said vertically movable support is a hydraulic actuator.

15. The finishing assembly of claim 12, wherein said vertically movable support is a pneumatic actuator.

16. The finishing assembly of claim 12, wherein said vertically movable support is an electromagnetic actuator.

17. The finishing assembly of claim 12, further comprising a locking mechanism mounted on one of said pivotable cantilever beam and said fixed cantilever beam for locking said fixed cantilever beam to said pivotable cantilever beam when said pivotable cantilever beam is in said first position.

18. The finishing assembly of claim 17, wherein said fixed cantilever beam is adapted to support at least one of said inside treatment rolls.

19. The finishing assembly of claim 17, wherein said fixed cantilever beam is adapted to support both inside treatment rolls.

20. The finishing assembly of claim 1, wherein at least one of said inside treatment rolls is heated.

21. The finishing assembly of claim 1, wherein at least one of said inside treatment rolls is a stretch roll.

22. The finishing assembly of claim 1, further including an outside treatment roll.

23. The finishing assembly of claim 22, wherein said out side treatment roll is adapted to be retracted into a recessed open space within the floor beneath said finishing assembly.

24. The finishing assembly of claim 23, further including a drive mechanism for raising and lowering said outside treatment roll from a first position to a second position.

25. The finishing assembly of claim 1, further including a movable oven for heating said endless web.

26. A cantilever beam assembly for use in a finishing assembly of the type including a pair of inside rolls for moving a web, having a predetermined lateral dimension, in a machine direction for treatment, said cantilever beam assembly comprising:

a. stationary support;

b. a pivotable cantilever beam having a supported end and a free end; and c. a mounting assembly for mounting said supported end of said pivotable cantilever beam to said stationary support for pivotable movement between a first position in which said pivotable cantilever beam is arranged transverse to the machine direction so as to be capable of supporting at least one of the inside rolls to permit loading and unloading of the web, and a second position in which said pivotable cantilever beam is arranged outside the lateral extent of the web so as not to interfere with treatment of the web.

27. The cantilever beam assembly of claim 26, wherein said cantilever beam assembly further comprises:

a. an opening through the supported end of said pivotable cantilever beam; and b. said mounting assembly further comprising i. a rotatably supported pin extending through said opening and connecting to said pivotable cantilever beam, such that said pivotable cantilever beam and said pin rotate together; and ii. an upper bearing and a lower bearing, wherein an upper end of said pin is mounted within the upper bearing, and a lower end of said pin is mounted within said lower bearing.

28. The cantilever beam assembly of claim 27, wherein said mounting assembly further comprises an actuator assembly carried by said stationary support and operatively connected to said pivotable cantilever beam.

29. The cantilever beam assembly of claim 28, wherein said actuator assembly comprises a gear actuator.

30. The finishing assembly of claim 29, wherein said gear actuator comprises:

a. a gear motor;

b. a gear drive driven by said gear motor;

c. a drive gear driven by said gear drive;

d. a beam gear attached to said pivotable cantilever beam, and meshing with said drive gear.

31. The cantilever beam assembly of claim 28, wherein said actuator assembly of said mounting assembly further comprises:

a. an actuator with a first end and a second end, the first end being pivotably attached to said stationary support;

b. an arm operatively connected to said pivotable cantilever beam and pivotably connected to said second end of said actuator, such that said arm is movable between a first position in which said pivotable cantilever beam is in its said first position and a second position in which said pivotable cantilever beam is in its said second position.

32. The cantilever beam assembly of claim 31, wherein said actuator is a screw jack.

33. The cantilever beam assembly of claim 31, wherein said actuator is hydraulic.

34. The cantilever beam assembly of claim 31, wherein said actuator is a pneumatic actuator.

35. The cantilever beam assembly of claim 31, wherein said actuator is an electromechanical actuator.

36. The cantilever beam assembly of claim 31, further including a vertically movable support for supporting said free end of said pivotable cantilever beam when said pivotable cantilever beam is in said second position.

37. The cantilever beam assembly of claim 36, wherein said vertically movable support is a vertical screw jack.

38. The cantilever beam assembly of claim 36, wherein said vertically movable support is a hydraulic actuator.

39. The cantilever beam assembly of claim 36, wherein said vertically movable support is a pneumatic actuator.

40. The cantilever beam assembly of claim 36, wherein said vertically movable support is an electromagnetic actuator.

41. The cantilever beam assembly of claim 36, further comprising a roll supporting device carried by said pivotable cantilever beam for support of an inside treatment roll.

42. The cantilever beam assembly of claim 41, further comprising a locking mechanism mounted onto said pivotable cantilever beam.

43. A finishing assembly for treating an endless web, said finishing assembly having a machine direction along which said endless web extends when loaded onto said finishing assembly, said finishing assembly comprising:

a. a cantilevered support comprising a fixed cantilever beam and a movable cantilever beam, said fixed cantilever beam extending in a generally horizontal direction transverse to the machine direction of said finishing assembly and having a supported end and a free end, and said movable cantilever beam extending in a generally horizontal direction and being mounted so as to be movable between a first position in which said movable cantilever beam extends in a direction generally transverse to the machine direction of said finishing assembly and a second position in which said movable cantilever beam does not interfere with said endless web, such that said fixed cantilever beam and said movable cantilever beam when in said first position defining a transversely-extending open space therebetween;

b. first and second inside treatment rolls for contacting the inside surface of the endless web to treat the endless web, at least one of said inside treatment rolls being movable between an endless web loading position and an endless web treatment position, said inside treatment rolls being arranged to be supported on at least one of said cantilevered beams when said at least one of said inside treatment rolls is in said endless web loading position, and said at least one of said inside treatment rolls being spaced from said fixed cantilevered beam in a direction generally parallel to the machine direction when said at least one of inside treatment rolls is in said endless web treatment position; and c. a movable roll carriage device for moving said at least one of said inside treatment rolls between said loading position and said treatment position.

* * * * *